US010442074B2

(12) United States Patent
Fulbright et al.

(10) Patent No.: US 10,442,074 B2
(45) Date of Patent: Oct. 15, 2019

(54) LOCKING MECHANISM

(71) Applicant: Wheelfloat, Inc., Southlake, TX (US)

(72) Inventors: Thomas G. Fulbright, Keller, TX (US); Jonathan D. Snook, Southlake, TX (US)

(73) Assignee: Wheelfloat, Inc., Southlake, TX (US)

( * ) Notice: Subject to any disclaimer, the term of this patent is extended or adjusted under 35 U.S.C. 154(b) by 512 days.

(21) Appl. No.: 15/134,565

(22) Filed: Apr. 21, 2016

(65) Prior Publication Data

US 2016/0311092 A1 Oct. 27, 2016

Related U.S. Application Data

(60) Provisional application No. 62/150,781, filed on Apr. 21, 2015.

(51) Int. Cl.

| | |
|---|---|
| ***B25G 1/08*** | (2006.01) |
| ***B25F 3/00*** | (2006.01) |
| ***B25F 5/02*** | (2006.01) |
| *B25F 1/04* | (2006.01) |

(52) U.S. Cl.

CPC ..... *B25G 1/085* (2013.01); *B25F 3/00* (2013.01); *B25F 5/029* (2013.01); *B25F 1/04* (2013.01)

(58) Field of Classification Search

CPC .... B25F 3/00; B25F 5/029; B25F 1/04; B25B 15/04; B25B 21/00; B25B 23/0035; B25G 1/085

USPC ..... 81/439, 177.4, 490

See application file for complete search history.

(56) References Cited

U.S. PATENT DOCUMENTS

| | | | | |
|---|---|---|---|---|
| 728,188 | A * | 5/1903 | Barstad | B25G 1/085 81/490 |
| 2,629,413 | A | 2/1953 | Stettler | |
| 3,006,395 | A | 10/1961 | Dye | |
| 3,750,729 | A | 8/1973 | Lemieux | |
| 4,372,362 | A | 2/1983 | Ahn | |
| 4,716,795 | A | 1/1988 | Corona et al. | |
| 4,762,036 | A | 8/1988 | Orlitzky et al. | |
| 5,325,745 | A | 7/1994 | Koehler | |
| 5,337,637 | A | 8/1994 | Bih-Lien | |
| 5,526,721 | A | 6/1996 | Waisvisz | |
| 5,673,600 | A | 10/1997 | Yanagi et al. | |
| 6,205,893 | B1 | 3/2001 | Sato | |
| 6,332,384 | B1 | 12/2001 | Cluthe | |
| 7,665,391 | B2 | 2/2010 | Beauchamp | |
| 2007/0251358 | A1 | 11/2007 | Grand et al. | |

* cited by examiner

*Primary Examiner* — Sunil K Singh
*Assistant Examiner* — Paul M Janeski
(74) *Attorney, Agent, or Firm* — Jack D. Stone, Jr.; Scheef & Stone, L.L.P.

(57) ABSTRACT

A locking mechanism for securing for use an item selected and retrieved from an opening in a storage device configured for storing one or more items, includes a tubular shaft extending from the opening in the storage device for receiving the selected item from the storage device. A passageway is defined within the tubular shaft for facilitating travel of the selected item from the opening in the storage device to an end of the shaft opposing the opening. At least one locking block and stop is configured for securing the selected item at the end of the tubular shaft opposing the opening.

18 Claims, 23 Drawing Sheets

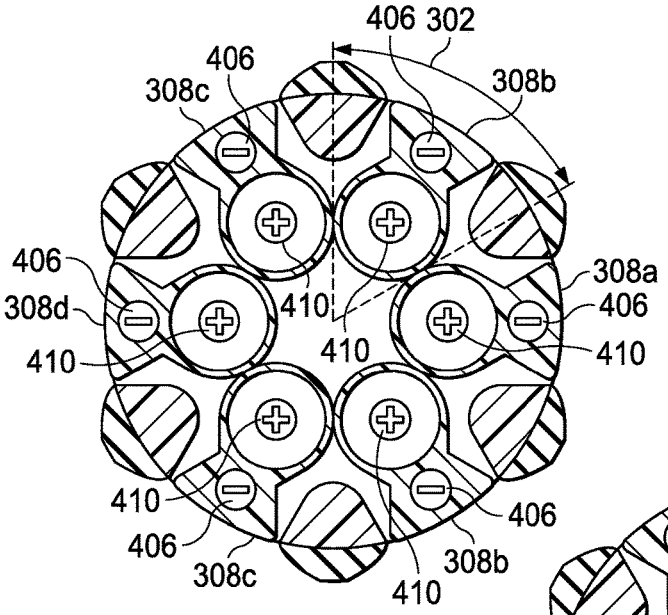
FIG. 8A
FIG. 8B
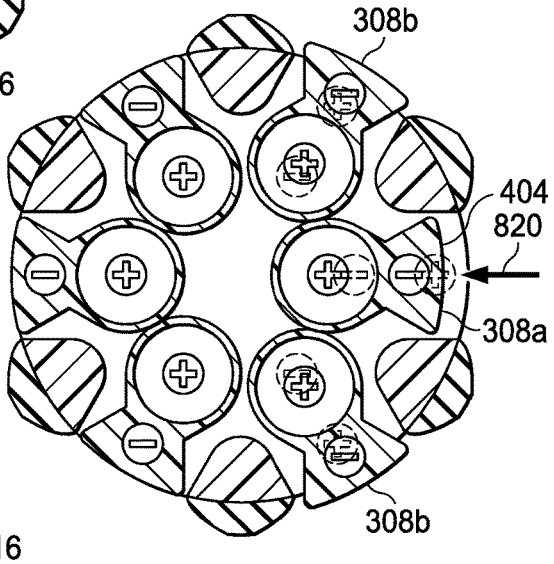
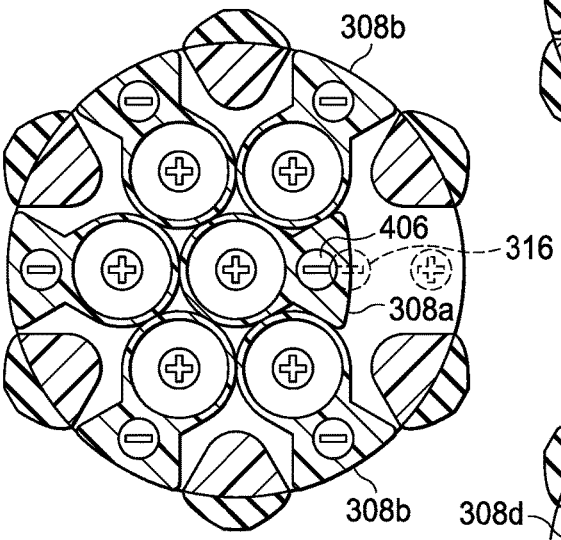
FIG. 8C
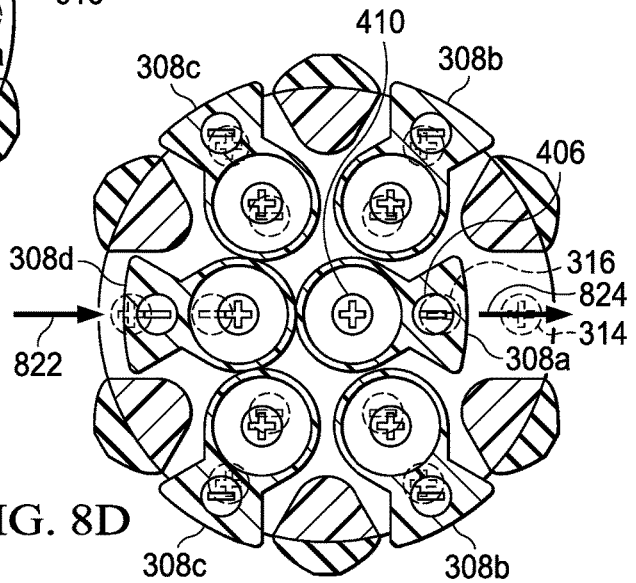
FIG. 8D

LOCKING MECHANISM

CROSS-REFERENCE TO RELATED APPLICATIONS

This application claims the benefit of U.S. Provisional Application No. 62/150,781, filed Apr. 21, 2015, which application is hereby incorporated herein by reference, in its entirety.

TECHNICAL FIELD

The invention relates generally to a locking mechanism and, more particularly, to a locking mechanism that secures a bit at the end of a screwdriver shaft.

BACKGROUND

It is common to have a large number of small items that must be stored in some manner. Such small items may include, by way of example, but not limitation, artist charcoal/pencils, children's crayons, drill bits, taps (for cutting threads), bobbins for sewing, spices, gauge pins, screwdriver bits, fishing weights, and the like. Often, small items are all stored together in a large bin, but it then becomes difficult to identify and retrieve any particular item. In other instances, a small box or drawer will be devoted to each item, but that often results in an inefficient use of space.

A screwdriver represents a particular case in point wherein a person may need a number of different screwdrivers to perform a task. This is particularly problematic, time consuming, and even dangerous, when such person is working on a ladder and must continually go up and down the ladder to fetch different screwdrivers. For such cases, screwdrivers are available which hold a number of different bits selectable by a user; such screwdrivers are referred to as multi-bit screwdrivers. There are, however, a number of drawbacks associated with "multi-bit" screwdrivers. The most common drawback is that such screwdrivers typically require two hands to change a bit, which can be dangerous when, for example, a user is standing atop a high ladder. Another common drawback is that the number of bits is very limited, such as six or even fewer bits. A still further drawback is that bits can be dropped or lost during handling.

In view of the foregoing, there is a need for a storage device that enables a large variety of different items of similar size to be readily stored and retrieved in a portable container and to be readily selectable for use and, further, to be secured in a position for such use.

SUMMARY

The present invention, accordingly, provides a locking mechanism for securing for use an item selected and retrieved from an opening in a storage device configured for storing one or more items. The locking mechanism includes a tubular shaft extending from the opening in the storage device for receiving the selected item from the storage device. A passageway is defined within the tubular shaft for facilitating travel of the selected item from the opening in the storage device to an end of the shaft opposing the opening. At least one locking block is configured for securing the selected item at the end of the tubular shaft opposing the opening.

In one embodiment, the one or more items comprise one or more bits. Each of the one or more bits defines a head portion and a base portion, wherein the base portion defines a plurality of sides, and wherein the tubular shaft defines an interior portion having a plurality of lands corresponding in number to the plurality of sides of the base portion of the one or more bits. The interior portion preferably defines an entry end proximate to the opening in the storage device, an exit end opposing the entry end, and the lands are smaller at the entry end than at the exit end, and substantially conform to the shape of the base portion of a selected bit at the exit end. The sides of the base portion are preferably concave, and also preferably conically canted toward the head portion.

In a further embodiment of the invention, the tubular shaft includes a barrel and a sleeve slidingly fitted about the barrel, the barrel including an entry end proximate to the opening in the storage device, and an exit end opposite the entry end. At least one opening is defined in a wall of the barrel, and at least one leaf spring is mounted on the barrel between the barrel and the sleeve, with at least one locking block mounted on the at least one leaf spring and positioned within the at least one opening of the barrel. The at least one leaf spring biases the at least one locking block toward the interior of the barrel. The at least one locking block is configured with at least one angled side to permit a selected item traveling along the barrel from the entry end to the exit end to move the at least one locking block back from the interior of the barrel to permit a selected item to travel past the locking blocks. When the selected item is proximate to the exit end of the barrel, the locking blocks move back toward the interior of the barrel and restrain the selected item from moving back toward the entry end of the barrel. The barrel preferably defines a stop at the exit end that, together with the locking blocks, locks an item in the exit end of the barrel. The at least one locking block and at least one opening are preferably configured with complementary wedge shapes that limit how far the at least one locking block may move toward the interior of the barrel.

In a still further embodiment, the tubular shaft further includes a barrel and a sleeve slidingly fitted about the barrel, the barrel including an entry end proximate to the opening in the storage device, and an exit end opposite the entry end, the sleeve being slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID. At least one coil spring is positioned for biasing the sleeve toward the first position, at least one opening defined in a wall of the barrel, at least one leaf spring mounted on the barrel between the barrel and the sleeve, and at least one locking block is mounted on the at least one leaf spring and positioned adjacent the at least one opening of the barrel. When the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the locking blocks to move away from the interior of the barrel. The at least one locking block is preferably configured with at least one angled side to permit a selected item traveling along the barrel from the entry end to the exit end to move the at least one locking block back from the interior of the barrel to permit the selected item to travel past the locking blocks. When the selected item is proximate to the exit end of the barrel, the locking blocks move back toward the interior of the barrel and restrain the item from moving back toward the entry end of the barrel, and a stop is preferably defined at the exit end that, together with the locking blocks, locks a item in the exit end of the barrel. The at least one locking block and at least one opening are preferably configured with complementary wedge shapes that limit how far the at least one locking block may move toward the interior of the barrel.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 8A-8D exemplify various states of cartridges positioned in a handle and taken along line 8-8 of FIG. 3D;

DETAILED DESCRIPTION

Figure 1:
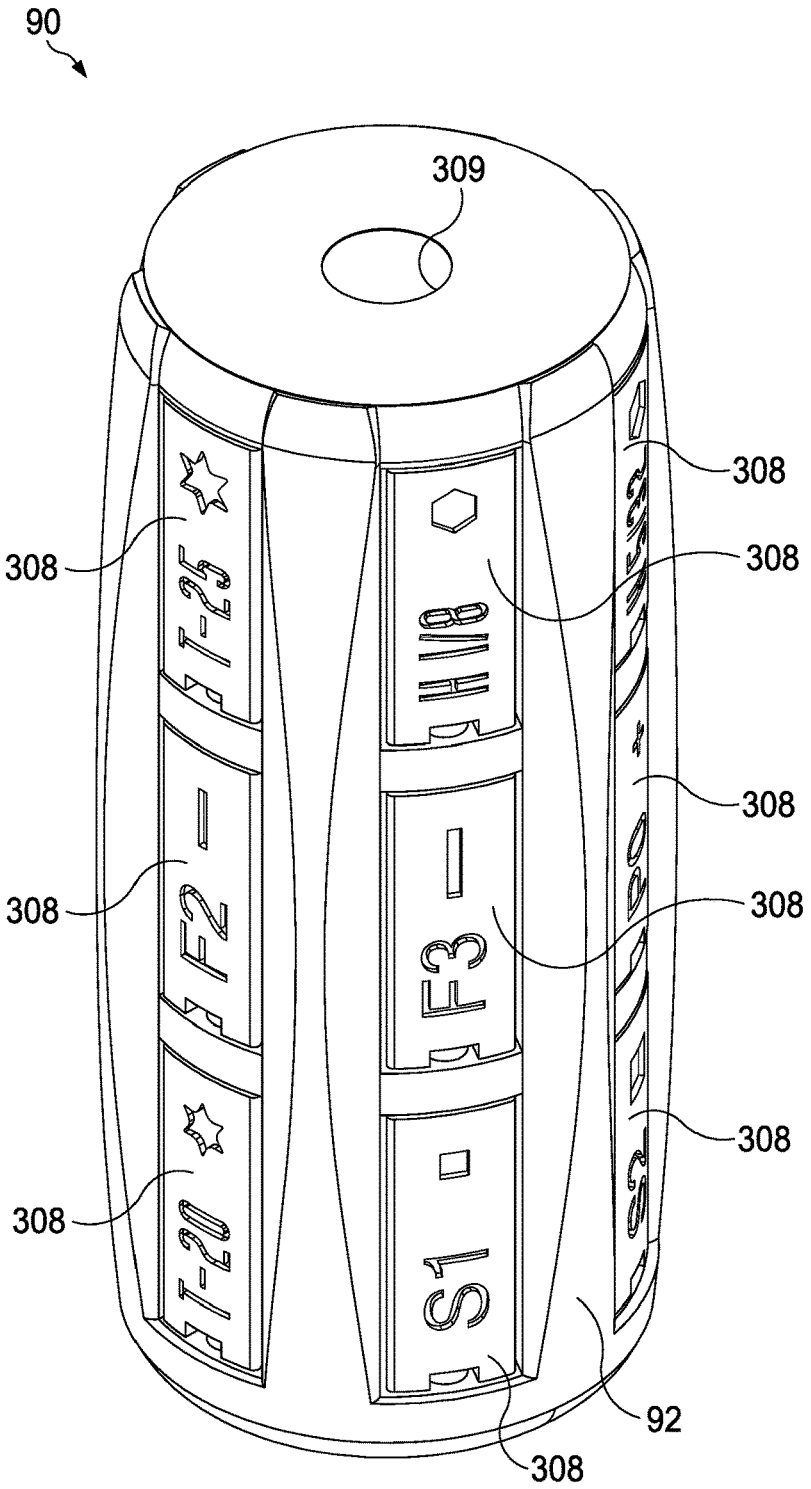
FIG. 1 is a perspective view of a storage device embodying features of the present invention.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation. Refer now to the drawings wherein like or similar elements are designated by the same reference numeral through the several views.

Referring to FIG. 1 of the drawings, the reference numeral 90 generally designates a storage device embodying features of the present invention for storing storage items such as, by way of example, but not limitation, artist charcoal/pencils, children's crayons, drill bits, taps (for cutting threads), bobbins for sewing, spices, gauge pins, bits for a screwdriver, fishing weights, and the like. The storage device 90 includes a number of cartridges 308, each of which defines a cavity (not shown in FIG. 1) for storing a single storage item. The storage device 90 includes a receiver 92 that defines at least one cell (not shown in FIG. 1) for receiving the at least one cartridge 308, and a passageway (not shown in FIG. 1) extending longitudinally along the center of the receiver to an opening 309 defined in an external surface of the receiver for inserting items into the unit, and for retrieving items from the unit. The passageway facilitates passage of a selected storage item between a cartridge 308 cavity and the opening 309. In the interest of efficiency, the storage device 90 is described in further detail below with respect to one application relating to a multi-bit screwdriver.

Figure 1A:
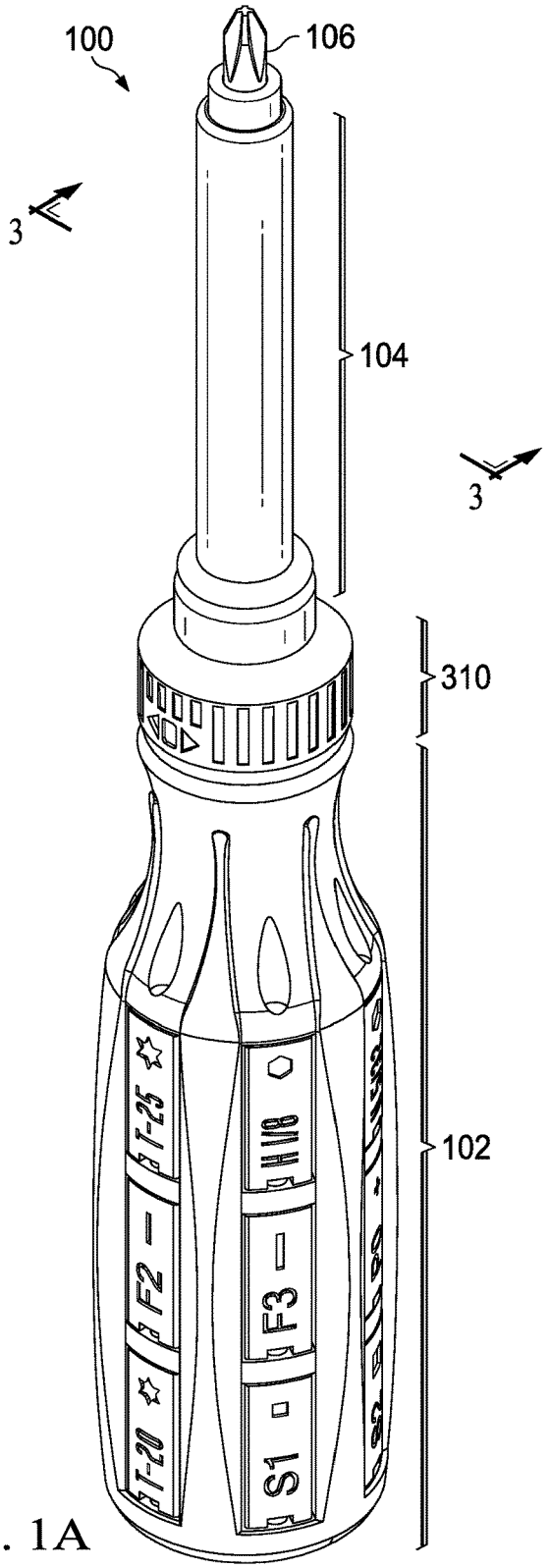
FIG. 1A is a perspective view of a screwdriver embodying features of the storage device of FIG. 1 and further of the present invention.

Accordingly, in FIG. 1A of the drawings, the reference numeral 100 generally designates a multi-bit screwdriver embodying features of the present invention. The screwdriver 100 preferably includes a handle portion 102, a ratchet 310, a shaft portion 104, and a bit portion 106, all of which portions will be described in further detail below.

Figure 2A:
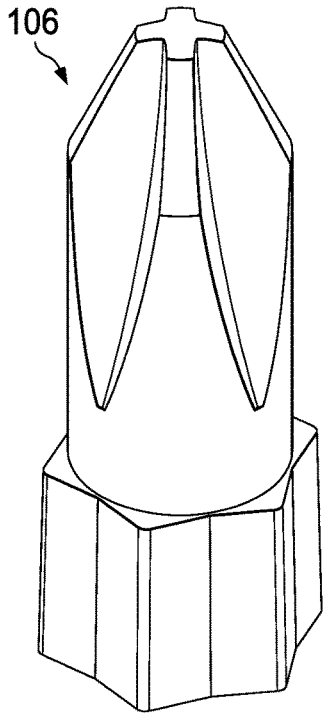
FIGS. 2A-2D exemplify a bit adapted for use with the screwdriver of FIG. 1A.
Figure 2B:
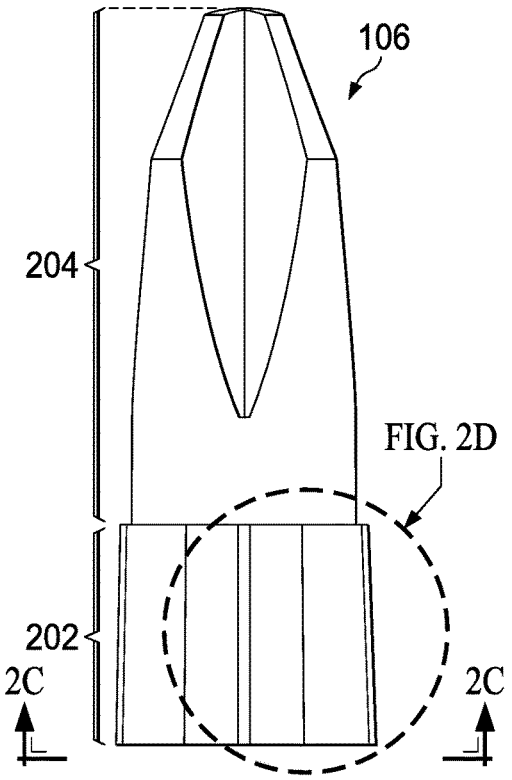
Figure 2C:
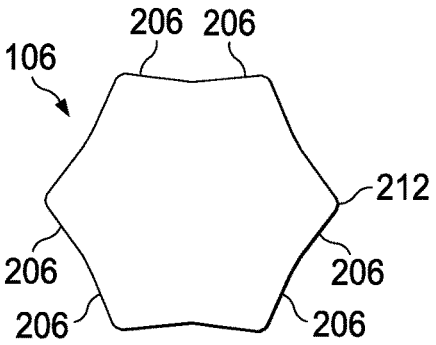
Figure 2D:
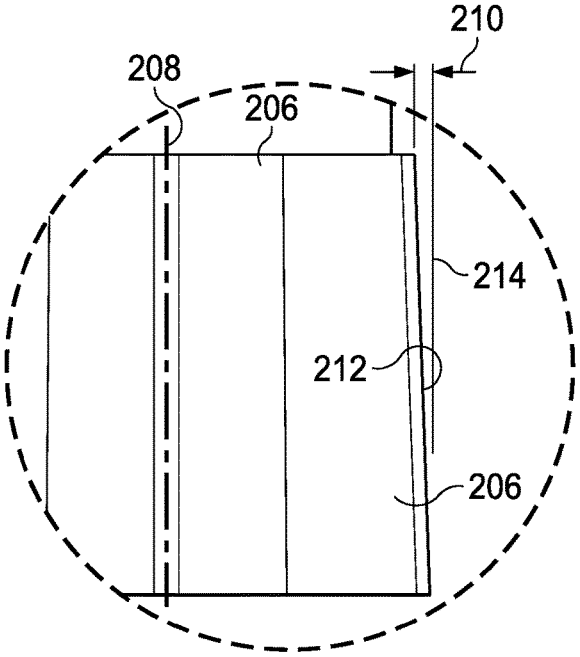

FIG. 2A is perspective view exemplifying the bit 106. FIG. 2B is a side view of the bit of FIG. 2A, and as shown therein, the bit 106 includes a base portion 202 and a head portion 204. Head portion 204 is depicted as a Philips head, but may be of any suitable or desirable shape, such as a slotted (flat) head, square, hex socket, Allen, spanner head, spline drive, or the like. Base portion 202 preferably includes a number of generally concave sides or surfaces 206 arranged in any suitable shape, such as a hexagon or six-pointed star having six generally concave sides in a preferred embodiment, depicted in FIG. 2C, or in alternative embodiments, base portion 202 may define any of a number of different shapes, such as a hexagon, pentagon, octagon, or the like with sides 206 which may be flat, but which are preferably concave, or the like, having edges, such as depicted by reference numeral 212. FIG. 2D shows sides 206 of the base portion 202, and the edge 212, preferably conically canted toward head portion 204 at an angle 210 from a line 214 parallel to a centerline 208 of the bit 106. The angle 210 is preferably about 1°, but may vary from 0° to about 10° for reasons discussed below. Bit 106 is preferably made from substantially hard, non-magnetic material, such as high manganese steel alloy, stainless steel, or the like.

Figure 3A:
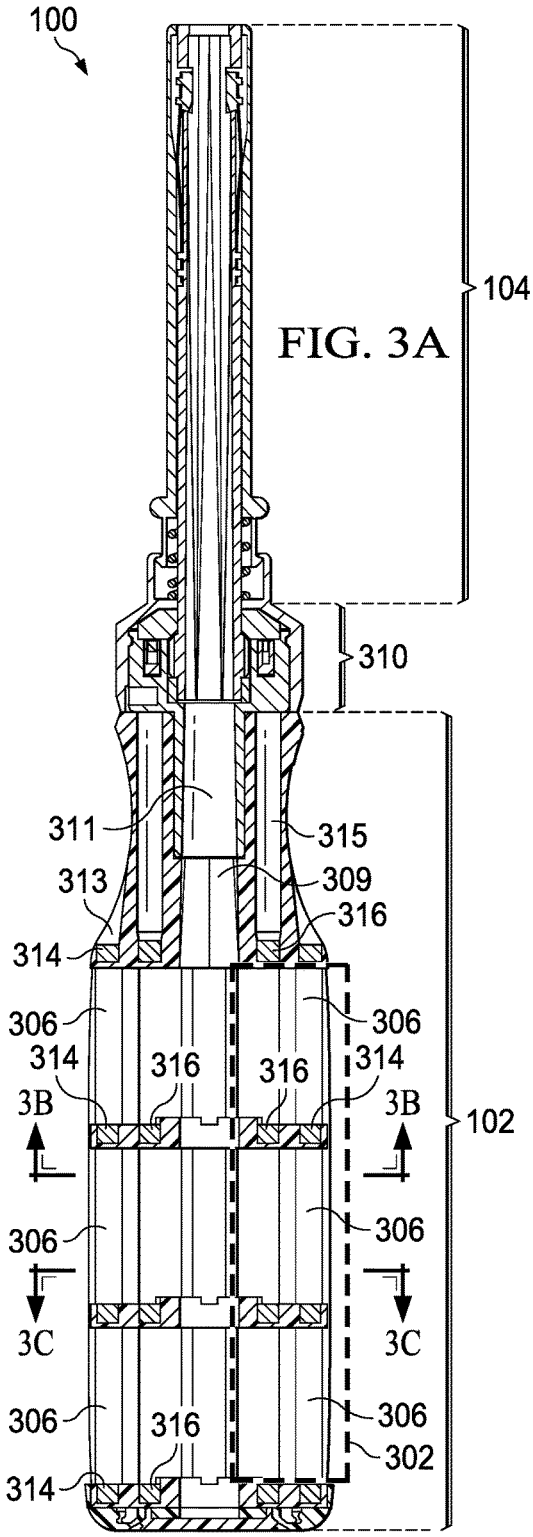
FIG. 3A is a cross-section of the screwdriver of the invention taken along line 3-3 of FIG. 1A.
Figure 3D:
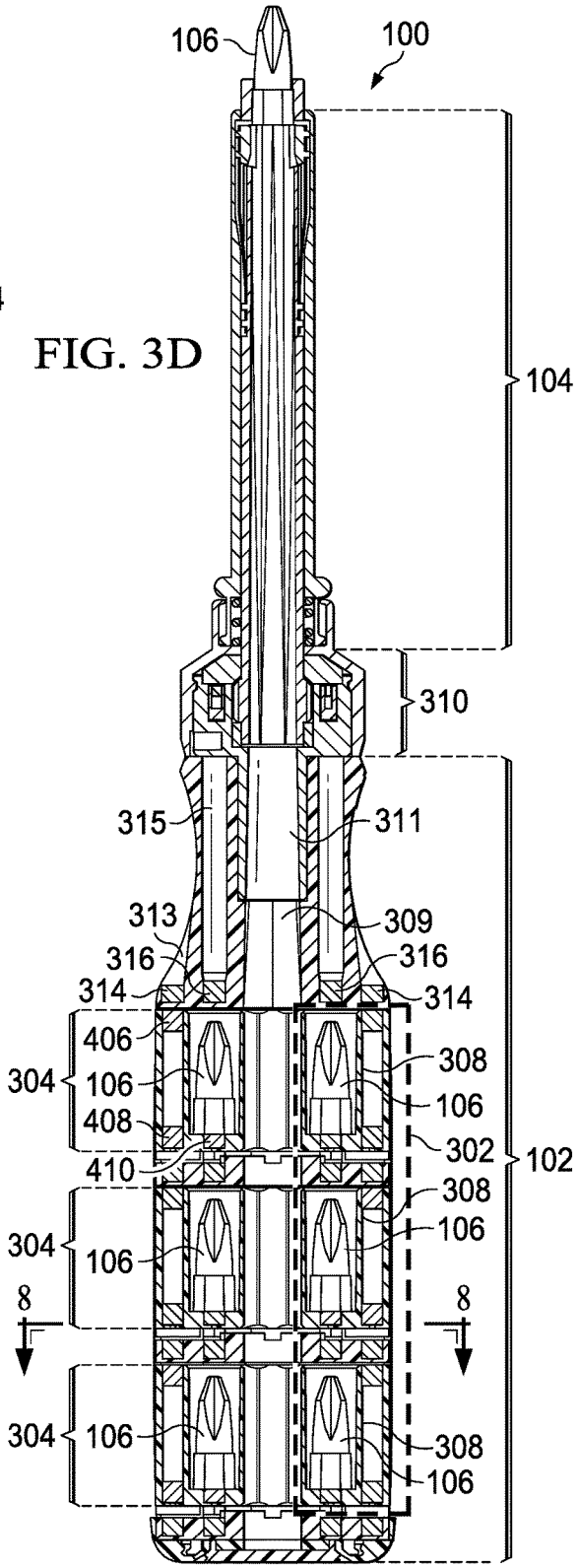
FIG. 3D is a cross-section of the screwdriver of the invention taken along line 3-3 of FIG. 1A.

FIGS. 3A and 3D are cross-sections of screwdriver 100 taken along line 3-3 of FIG. 1. Handle 102 preferably defines six columns 302, though more or less such columns may be so defined. Each column 302 includes at least one row 304 (three of which rows are exemplified in FIG. 3D), and each row 304 of each column 302 defines one respective cell 306 for holding one respective cartridge 308, discussed below. The screwdriver 100 preferably also includes a ratchet mechanism 310, which may comprise any conventional ratchet mechanism, but preferably a ratchet as taught in co-pending patent application Ser. No. 14/677,698, filed Apr. 2, 2015, and incorporated herein by reference in its entirety.

Figure 3B:
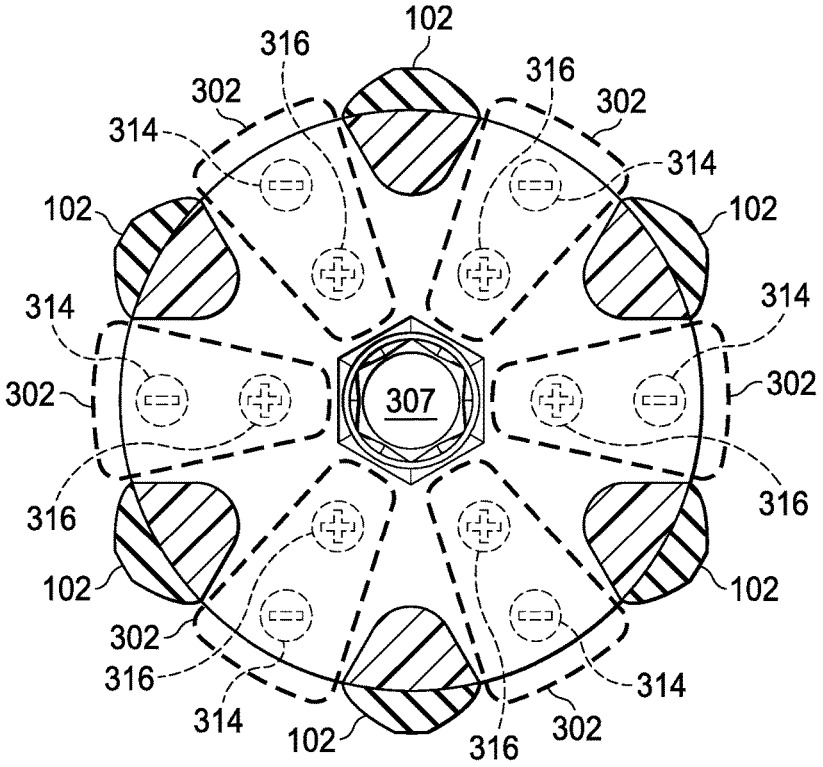
FIG. 3B is a cross-section of the screwdriver of the invention taken along line 3B-3B of FIG. 3A.
Figure 3C:
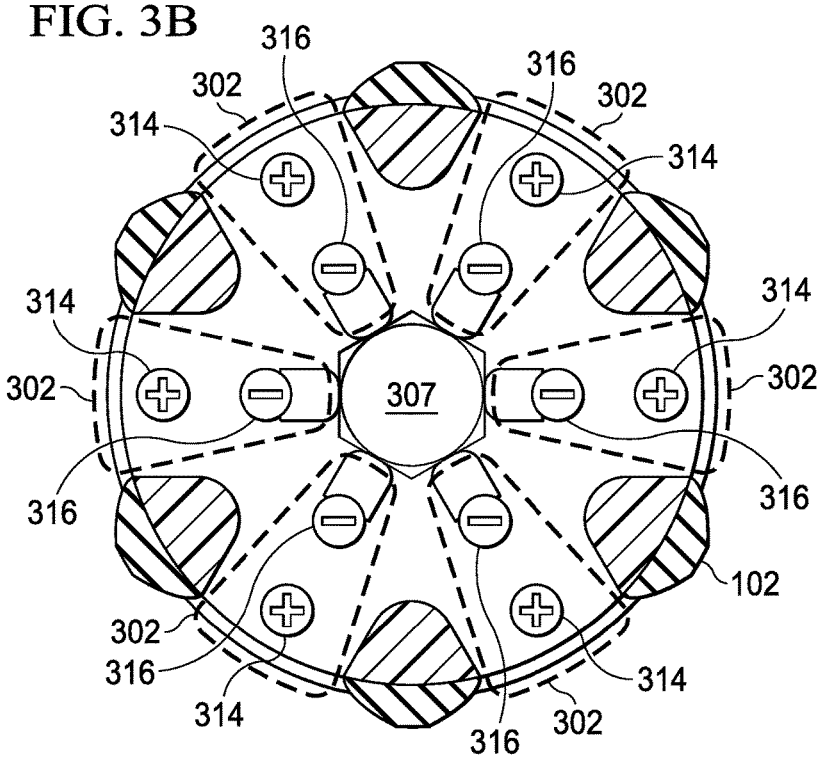
FIG. 3C is a cross-section of the screwdriver of the invention taken along line 3C-3C of FIG. 3A.
Figure 4:
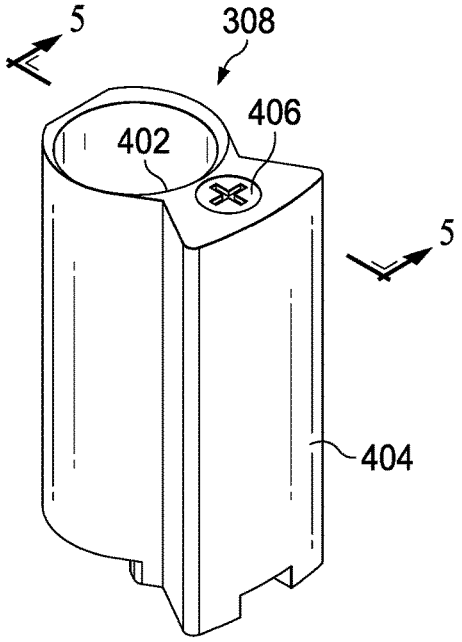
FIGS. 4-7 exemplify various views of a cartridge adapted for holding a bit for use in a screwdriver of the invention.
Figure 6A:
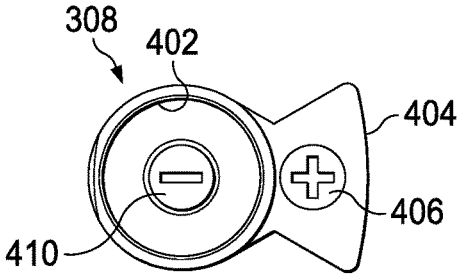
Figure 6B:
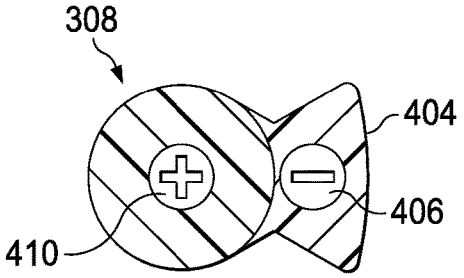
Figure 5:
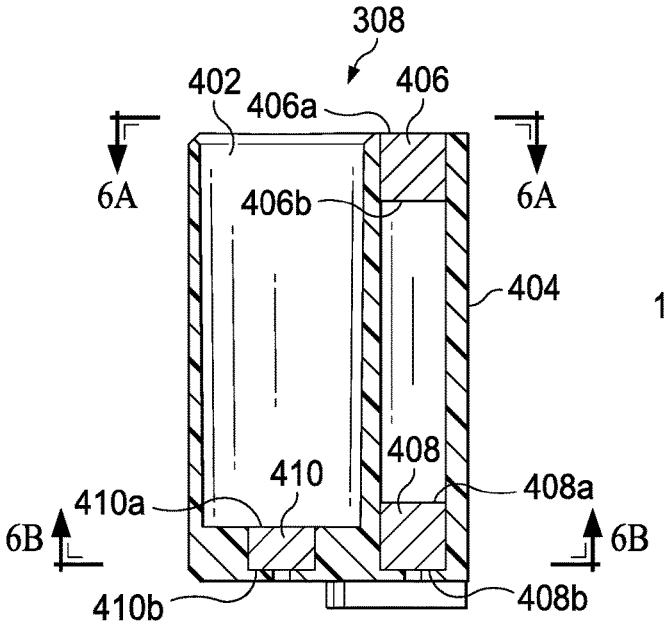
Figure 7:
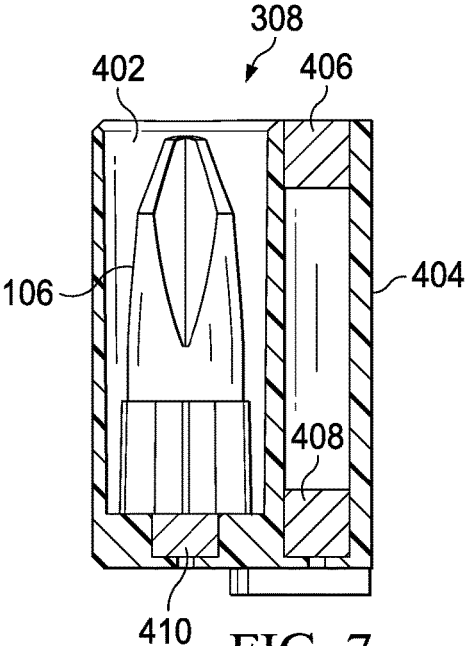

FIGS. 3B and 3C depict a view of upper and lower cell surfaces, respectively, of a row 304 of cells 306. As shown in FIG. 3C and in dashed outline in FIG. 3B, each upper and lower surface preferably includes two receiver magnets 314 and 316 embedded therein in each cell 306. The north and south polarities of the magnets are designated in the drawings by positive and negative signs ("+" and "−"), respectively. The magnets 314 and 316 are preferably oriented to have opposite polarities. While polarities of magnets 314 and 316 are depicted of particular polarities, polarities may be reversed so long as resultant magnetic interactions are consistent with interactions caused by polarities described herein.

FIGS. 4-7 depict a cartridge 308 configured to receive and hold bit 106 in cell 306, and preferably fabricated from a non-magnetic material such as plastic, high manganese steel alloy, stainless steel, or the like. The cartridge 308 defines a cavity 402 for receiving bit 106 (FIG. 7), and a button 404. The cartridge 308 preferably includes three cartridge magnets, namely, a cavity magnet 410 positioned at the bottom of the cavity 402, and upper and lower magnets 406 and 408 positioned in upper and lower portions of the button 404. The polarity of the magnets 406 and 408 is preferably oriented the same, and opposite that of magnet 410. As exemplified most clearly in FIG. 5, the positive or north ends of magnets 406, 408, and 410 is represented by ends 406*a*, 408*a*, and 410*b* respectively; thus, as viewed in FIGS. 5, 6A, and 6B, positive or north ends 406*a* and 408*a* of magnets 406 and 408 are oriented upwardly, and the positive or north end 410*b* of magnet 410 is oriented downwardly. Conversely, the negative or south ends of magnets 406, 408, and 410 is represented by ends 406*b*, 408*b*, and 410*a* respectively; thus, as viewed in FIGS. 5, 6A, and 6B, negative or south ends 406*b* and 408*b* of magnets 406 and 408 are oriented downwardly, and the negative or south end 410*a* of magnet 410 is oriented upwardly.

Referring back to FIG. 3D, as discussed above, the screwdriver 100 includes handle 102, which includes a number of columns 302, each of which columns includes at least one row 304 (three of which rows are exemplified in FIG. 3D), and each row 304 of each column 302 defines one respective cell 306. As shown in FIG. 3D, a cartridge 308 is positioned in each cell 306. For purposes of illustration, each cartridge is shown holding a Philips head bit, though typically, various bits, discussed above, would be stored in the cartridges. The screwdriver 100 further preferably includes a passageway 309 and a funnel 311 (with a lower opening slightly larger than an upper opening) for facilitating and directing the passage of bits between passageway 307 (FIGS. 3B, 3C) of the handle 102 and the shaft 104. Bores 313 and 315 are preferably formed for the purpose of facilitating placement of magnets 314 and 316, respectively, in the upper row of cells 306 of the handle 102.

FIG. 8A depicts a cross section of one row 304 of the handle 102 taken along line 8-8 of FIG. 3D. The row is exemplified in handle 102 having six columns 302, and hence, six cells 306 and six cartridges 308. For purposes of illustration of operation, letters are appended to the cartridges 308 to distinguish them, one from another. FIGS. 8B-8D will be discussed further below with respect to operation of the screwdriver.

Figure 9A:
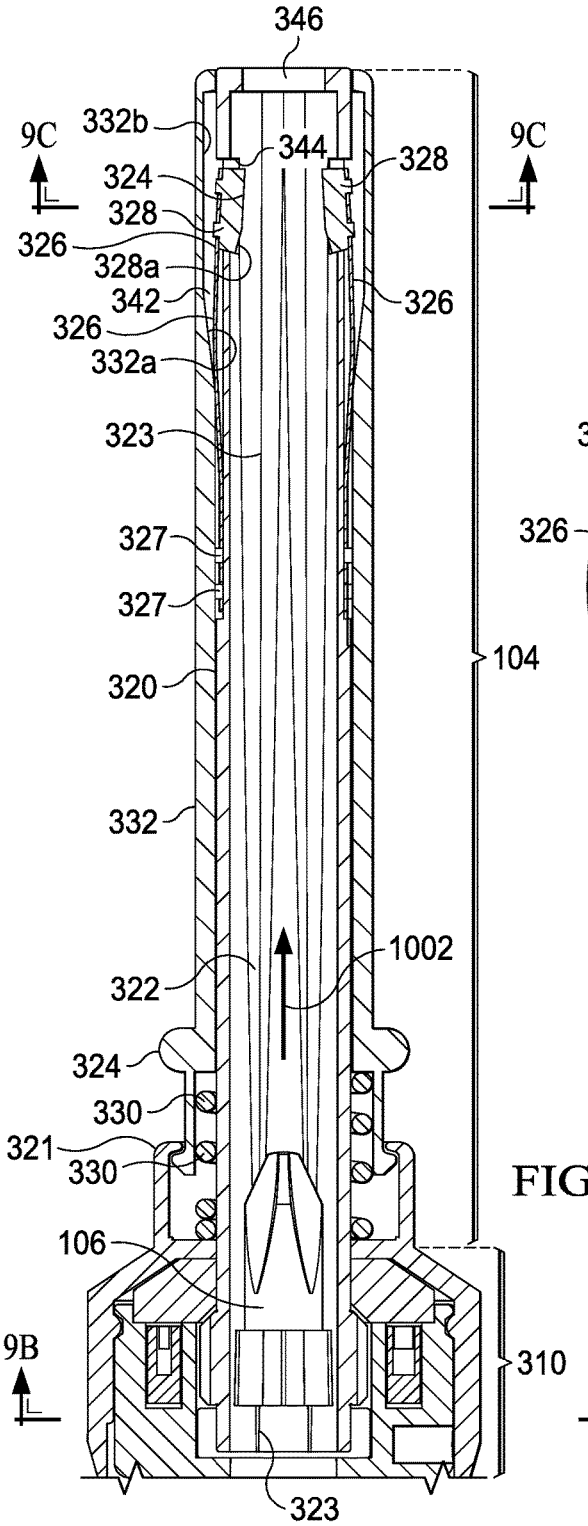
FIG. 9A exemplifies a shaft of a screwdriver of the invention.
Figure 11A:
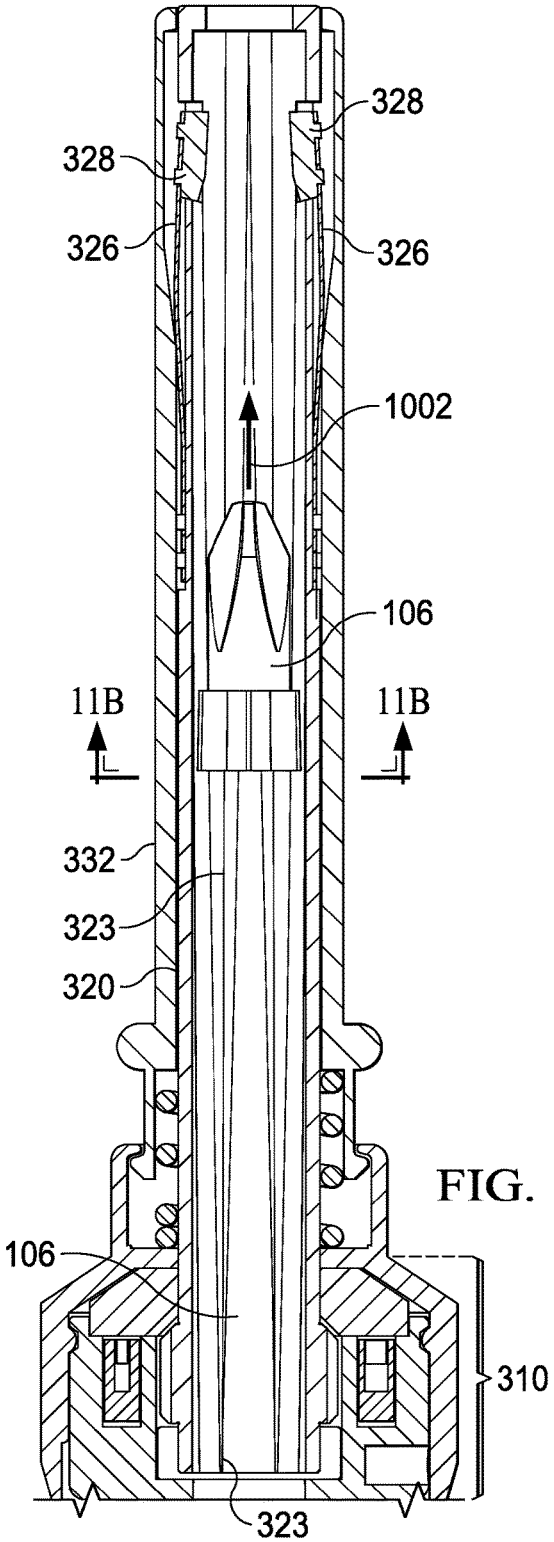
FIG. 11A exemplifies a shaft of a screwdriver of the invention having a bit moving upwardly inside a barrel of the shaft.
Figure 11B:
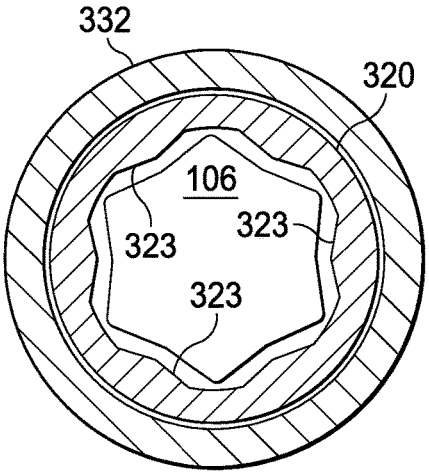
FIG. 11B shows a cross-section of the shaft taken along line 11B-11B of FIG. 11A.
Figure 12A:
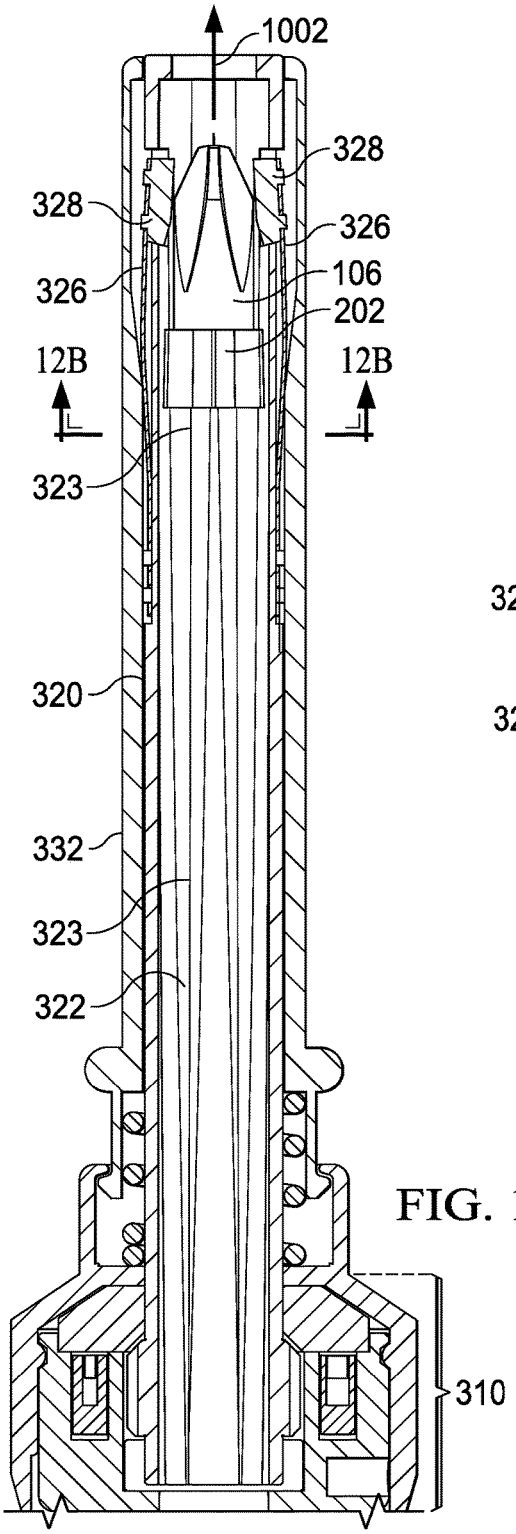
FIG. 12A exemplifies a shaft of a screwdriver of the invention having a bit moving upwardly inside a barrel of the shaft.
Figure 12B:
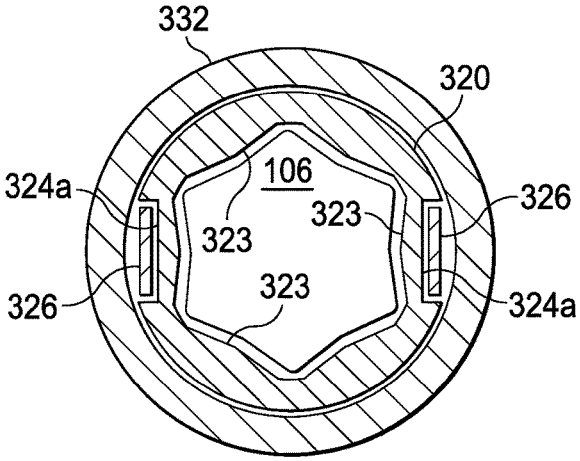
FIG. 12B shows a cross-section of the shaft taken along line 12B-12B of FIG. 12A.
Figure 13:
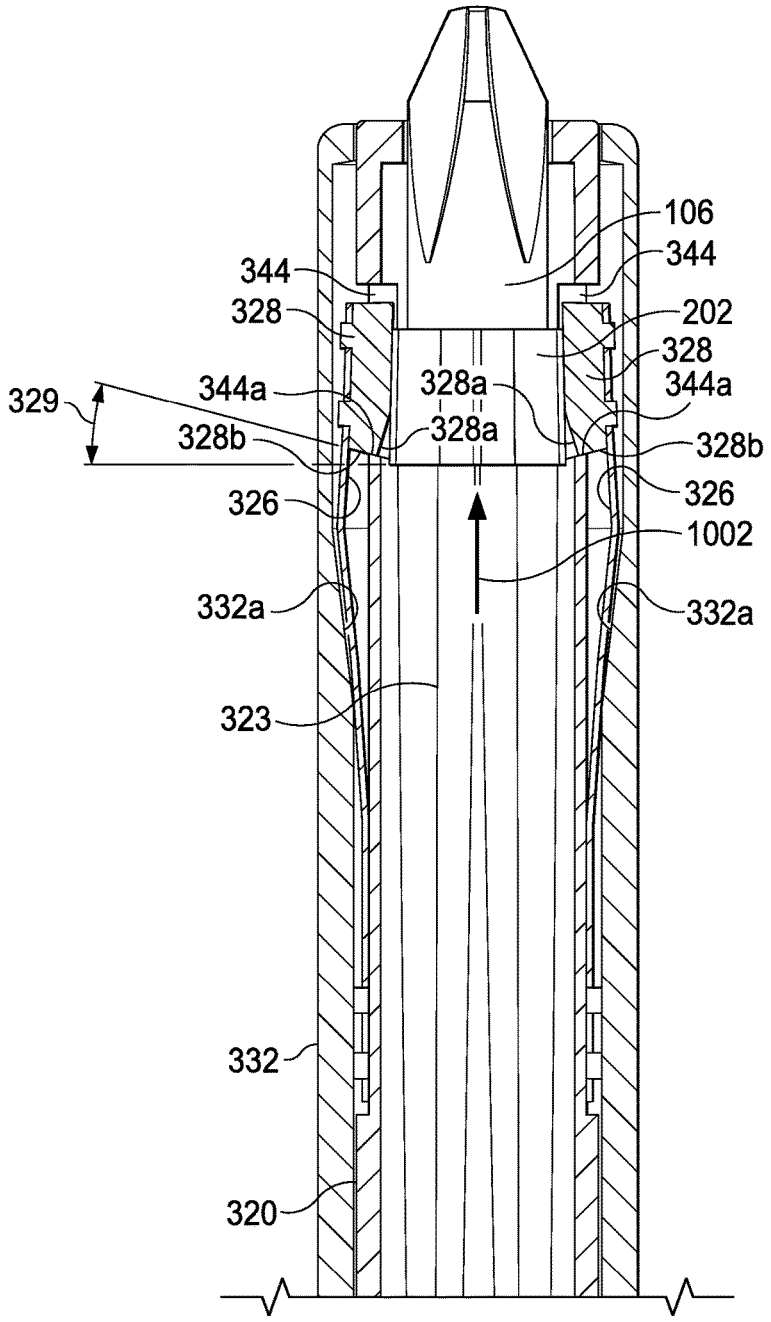
FIG. 13 exemplifies a shaft of a screwdriver of the invention having a bit moving upwardly inside a barrel of the shaft.

FIG. 9A depicts a cross-section of the shaft 104 and ratchet mechanism 310 taken along line 3-3 of FIG. 1A. The shaft 104 includes a barrel 320 rotatably fixed to the ratchet mechanism 310 and handle 102. A sleeve 332 is slidably positioned about barrel 320, and restrained in axial movement by a catch 321. A spring 330 urges the sleeve against the catch 321, and a finger pull 324 is positioned on the sleeve for enabling a user to use a finger (or alternatively a thumb) to pull the sleeve back against the bias of spring 330. The interior of barrel 320 is preferably configured with a number of lands 322 that are tapered so that the barrel interior has a substantially circular cross-section at a lower end (as viewed in FIG. 9A) which tapers, at an upper end (as viewed in FIG. 9A), to a substantially polygonal shape, preferably a generally hexagonal or six-pointed star shape having six generally convex sides as shown in FIGS. 12B and 14B and corresponding to the sides of the bit shown in FIG. 2C. The taper of lands 322 along the barrel are seen more clearly in FIGS. 9A-15, discussed below in connection with the operation of the screwdriver 100. The number and shape of sides of the polygonal cross-section correspond to the number and shape of lands 322 of the barrel, which corresponds to the number and shape of sides of base 202 of bit 106. In a preferred embodiment, depicted in the figures, base 202 of bit 106 consists of six generally concave sides, as shown in FIG. 2C, and the barrel consists of six generally convex lands configured at the upper end to matingly engage the six generally concave sides 206 of base 202.

Figure 14A:
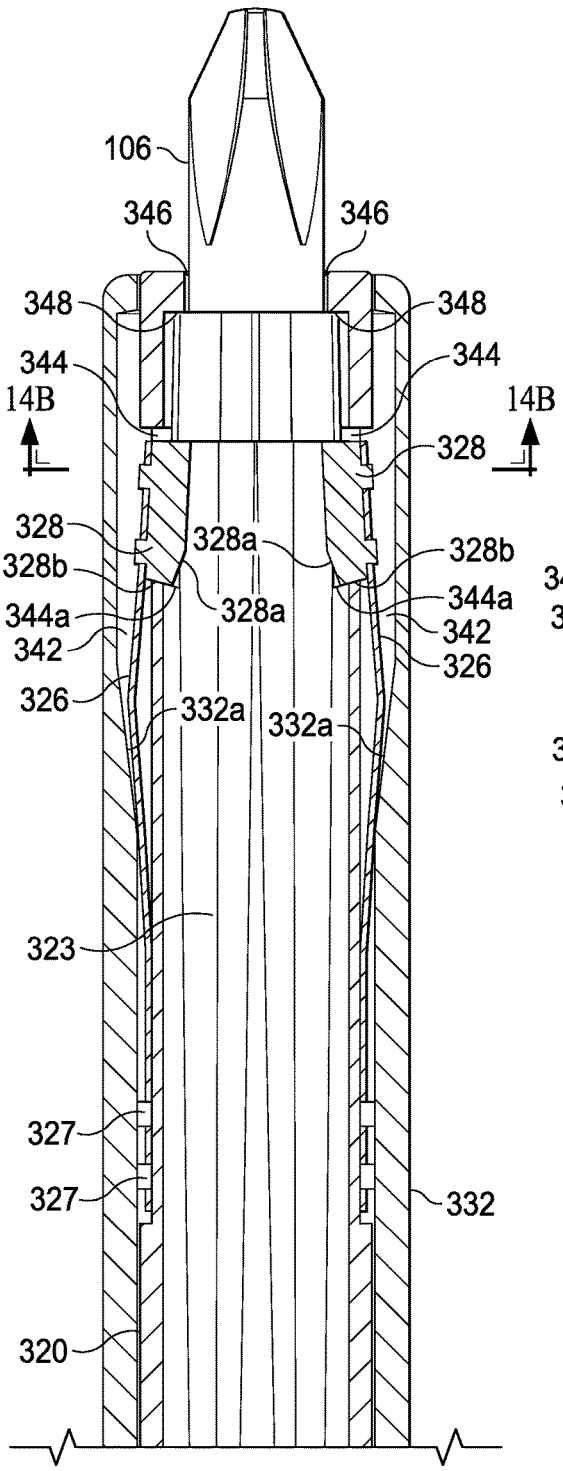
FIG. 14A exemplifies a shaft of a screwdriver of the invention having a bit in position for use.
Figure 14B:
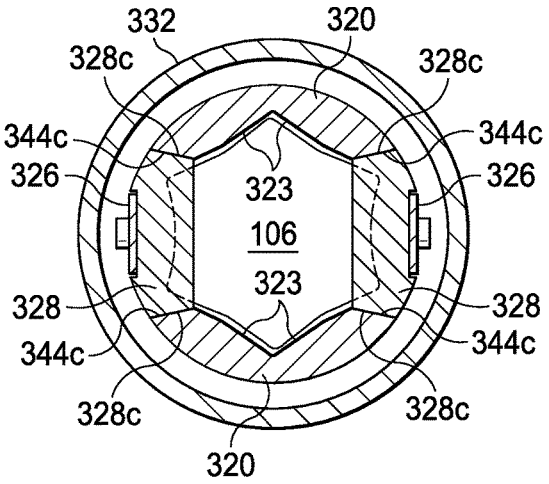
FIG. 14B shows a cross-section of the shaft taken along line 14B-14B of FIG. 14A.
Figure 15:
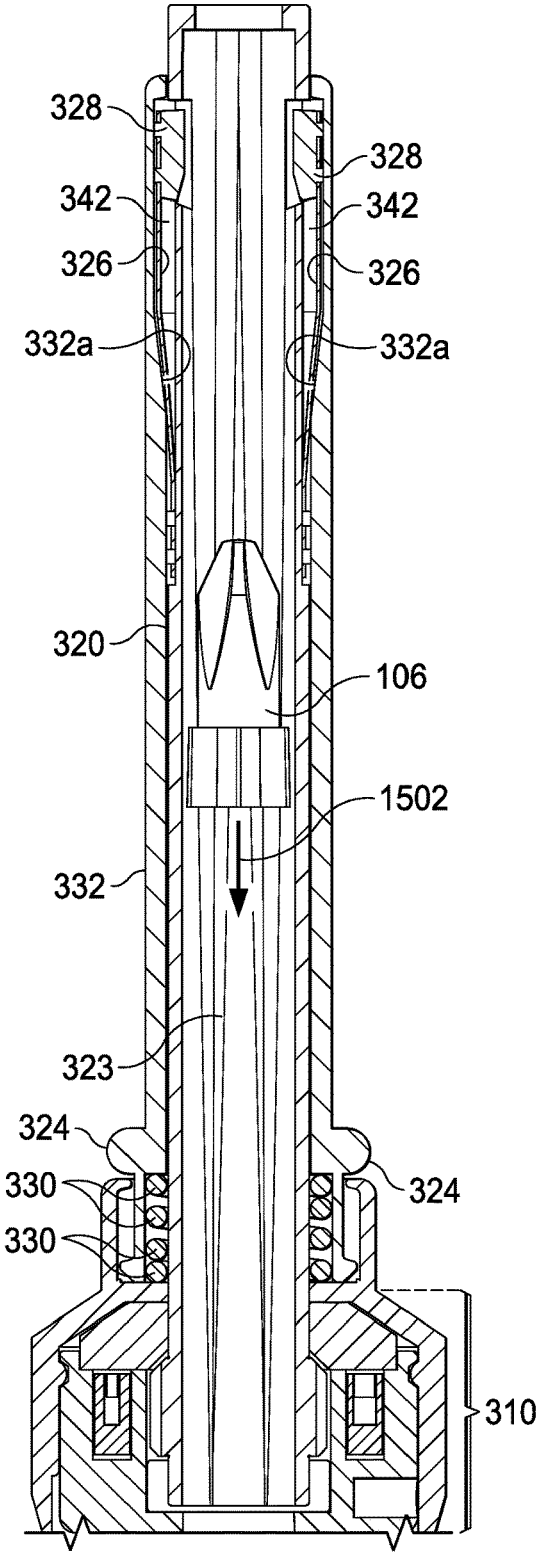
FIG. 15 exemplifies a shaft of a screwdriver of the invention having a bit moving downwardly inside a barrel of the shaft.

As more clearly depicted in FIG. 14A, toward the upper end of barrel 320 and sleeve 332, the inside diameter of sleeve 332 opens along a taper 332*a* creating space 342. A leaf spring 326 is positioned between barrel 320 and sleeve 332 and secured thereto at 327 using securing means, such as conventional staking or clipping. A locking block 328 is positioned and secured atop each leaf spring 326. When sleeve 332 is in an upward position (as shown in FIGS. 9A, 10A, 11A, 12A, 13, and 14A), the taper 332*a* presses against leaf springs 326 causing the leaf springs to bias locking blocks 328 toward two corresponding openings 344 defined in the barrel 320. Locking blocks 328 are further preferably provided with bottom surfaces 328*b* which seat on corresponding lower surfaces 344*a* of openings 344, both of which bottom surfaces 328*b* and lower surfaces 344*a* are inclined downwardly into the interior of barrel 320 at an angle 329 (FIG. 13) greater than zero but less than about 30° to further bias locking blocks 328 into openings 344. To prevent locking blocks 328 from falling into and through openings 344, sides 328*c* (FIG. 14B) of the locking blocks are configured in a wedge shape which wedges against sides 344*c* of openings 344. The wedging action is particularly acute when a load is applied to bit 106 (FIG. 14A) which then urges wedge-shaped sides 328*c* of locking blocks 328 inwardly against wedge-shaped sides 344*c* of openings 344, thus providing a backstop for supporting bit 106 under load. Locking blocks 328 preferably also define tapers 328*a* at lower ends of the barrel side of the blocks, for pushing locking blocks 328 outwardly against leaf spring 326 pressure, upon contact with bit 106, and allowing bit 106 to pass when it is moving upwardly through barrel 320, as shown in FIG. 13. Leaf spring 326 pressure is such that momentum of traveling bit 106 is capable of overcoming pressure and thereby pushes locking blocks 328 out of the bit path. * Once bit 106 passes the locking blocks, the locking blocks return to the position of blocking the bit from moving back into the barrel 320. Bit 106 continues travel toward an opening 346 at the end of barrel 320, and is restrained from traveling of the barrel by stop 348. It may be appreciated that as a user uses a finger to pull the sleeve 332 back, as depicted in FIG. 15, the taper 332*a* moves downwardly allowing leaf springs 326 to expand outwardly into space 342, and locking blocks 328 to move outwardly from the openings 344 of the barrel 320. It may also be appreciated that surfaces of locking blocks 328 may be suitably curvilinear (i.e., non-flat) to conform with openings 344 and fit within the curved space 342. It may be further appreciated that the combination of locking blocks 328, leaf spring 326, sleeve 332, and stops 348 form a locking mechanism to secure a bit 106 in place at the end of the shaft 104.

In operation, with bits 106 loaded in cartridge cavities 402, a user selects bit 106 as shown most clearly by FIGS. 8A-8D, showing a cross-section of handle 102 taken along line 8-8 of FIG. 3D. FIG. 8A depicts an initial state of cartridges 308 in handle 102. By way of example, if a user desires to use bit 106 in cartridge 308*a*, then he would apply force with a finger to button 404 of cartridge 308*a* in a direction indicated by arrow 820. As cartridge 308*a* is pushed inwardly, cartridges 308*b* are pushed outwardly, until cartridge 308*a* is positioned as shown in FIG. 8C, at which point cartridges 308*b* are restored to their original position, which tends to hold cartridge 308*a* in its new position shown in FIG. 8C. The negative polarity of magnet 408 of cartridge 308*a* and the negative polarity of magnet 316 (FIG. 3C), together with the positive polarity of magnet 406*a* of cartridge 308*a* and magnet 316 (FIG. 3B) further tend to repel and thereby restrain cartridge 308*a* in the position of FIG. 8C.

Figure 9C:
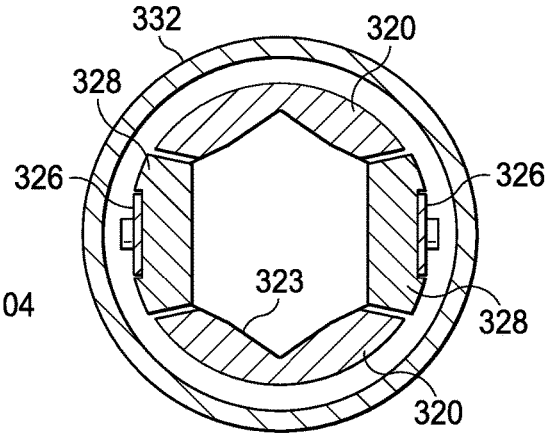
FIG. 9C shows a cross-section of the shaft taken along line 9C-9C of FIG. 9A.
Figure 9B:
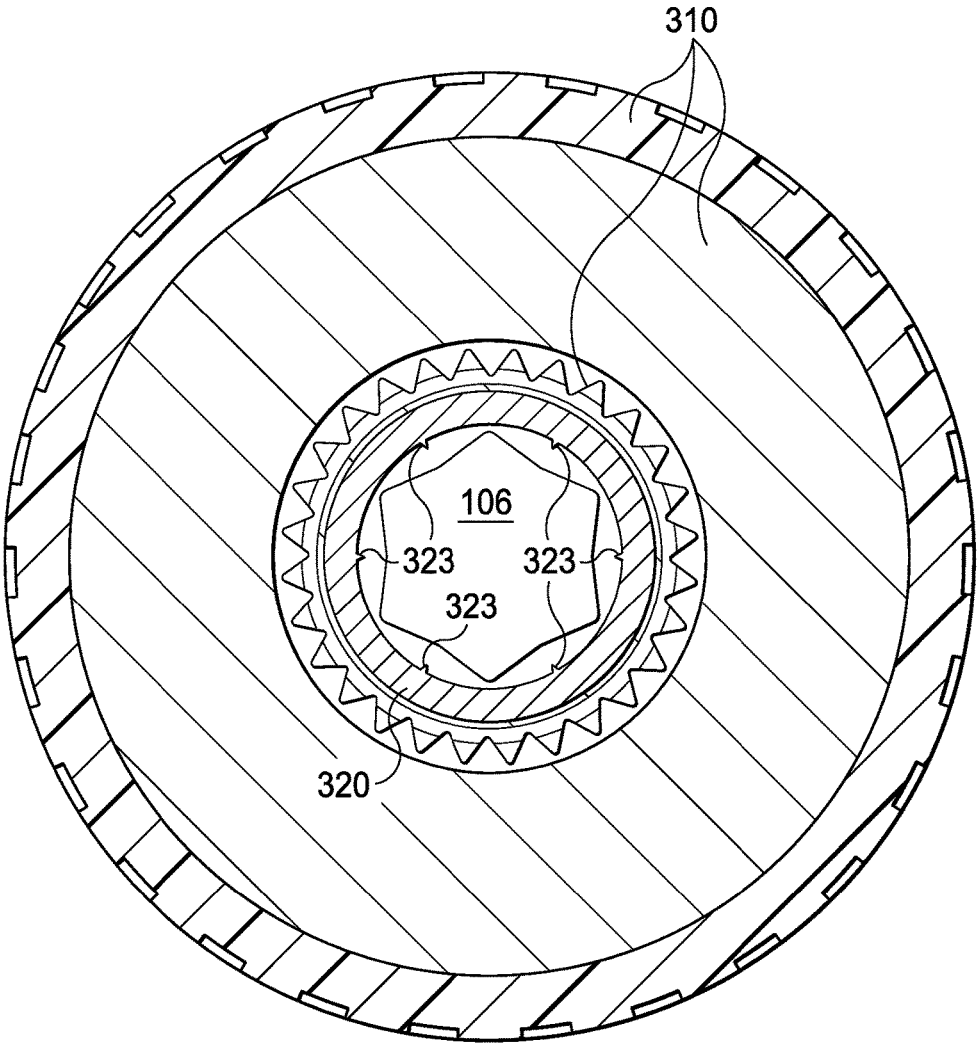
FIG. 9B shows a cross-section of the shaft taken along line 9B-9B of FIG. 9A.
Figure 10A:
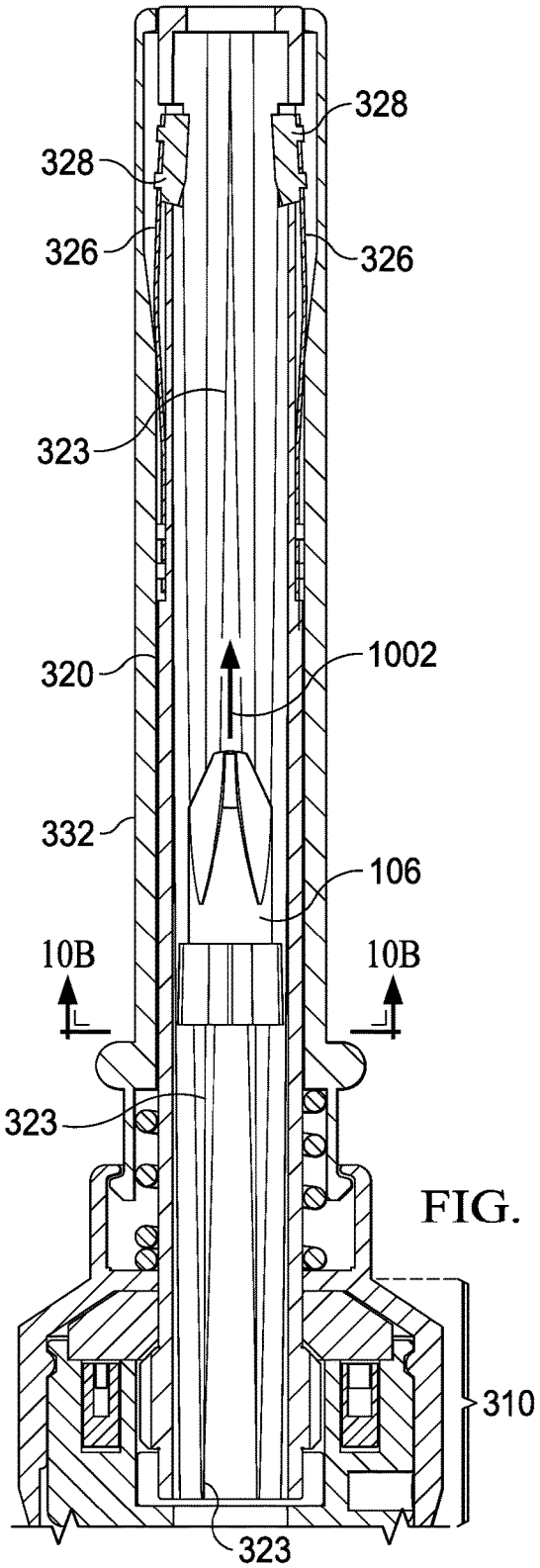
FIG. 10A exemplifies a shaft of a screwdriver of the invention having a bit moving upwardly inside a barrel of the shaft.
Figure 10B:
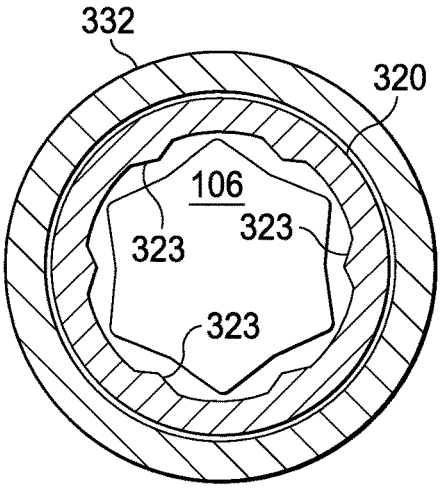
FIG. 10B shows a cross-section of the shaft taken along line 10B-10B of FIG. 10A.

Once cartridge 308*a* is in the position of FIG. 8C, the bit 106 positioned in cavity 402 of cartridge 308*a* is aligned with the center of the barrel 320. A user may then flick the screwdriver 100 with his or her hand to apply centrifugal force to move the bit 106 into and along the barrel 320 as shown in FIG. 9A. FIG. 9B shows how the barrel 320 cross-section is substantially circular, with small lands 323. FIG. 9C shows the normal position of locking blocks 328 when bit 106 is not in position for use. FIG. 10A shows bit 106 moving upwardly in the direction of arrow 1002, and FIG. 10B shows how the lands 323 are enlarging. FIG. 11A shows bit 106 continuing to move upwardly in the direction of arrow 1002, and FIG. 11B shows how lands 323 continue to enlarge toward the sides 206 of base 202 of bit 106. FIG. 12A shows bit 106 continuing to move upwardly in the direction of arrow 1002 toward the locking blocks 328, and FIG. 12B shows how lands 323 continue to enlarge toward the sides 206 of base 202 of bit 106, almost coinciding with them. FIG. 13 shows bit 106 continuing to move upwardly and engaging locking blocks 328, causing locking blocks 328 to move outwardly, against spring 326 pressure, as bit 106 passes them. FIG. 14A shows bit 106 in position just above locking blocks 328 sufficiently to allow locking blocks 328 to re-enter openings 344 and prevent bit 106 from moving downwardly, while stops 348 prevent bit 106 from moving upwardly, thereby securing bit 106 in position for use. FIG. 14B shows how the lands 323 fully engage the sides 206 of the base 202 of bit 106, thereby preventing bit 106 from rotating, rendering bit 106 ready for use. It can be appreciated that the configuration of the lands 323 allows a bit 106 to enter barrel 320 at virtually any angular orientation, and to be adjusted in its orientation as it moves along inside the barrel so that at the upper end of the barrel, the bit is properly oriented with the shaft 104, secured therein, and ready for use in the screwdriver 100.

When bit 106 is no longer needed or another bit is desired, bit 106 may be restored to its cartridge 308 by using a finger or thumb to pull downwardly on the finger pulls 324, thereby pulling taper 332*a* back, and allowing leaf springs 326 to expand outwardly into space 342, thereby allowing bit 106 to fall back into the barrel, until it lands in cavity 402 of its respective cartridge 308, positioned as shown in FIG. 8C. With reference to FIG. 8D, a user may then press button 404 of cartridge 308*d* in the direction of arrow 822 to push cartridge 308*a* in the direction of arrow 824 back to its original position of FIG. 8A, but without pushing cartridge 308*d* to a position as shown by cartridge 308*a* in FIG. 8C. When cartridge 308*d* pushes cartridge 308*a* far enough for magnets 406 and 408 (FIGS. 4-7) of cartridge 308*a* to pass over magnets 316 (FIGS. 3B, 3C), the magnetic force repels the cartridge back to its original position as shown in FIG. 8A. At this point, the user stops pushing in the direction of arrow 822 and magnetic forces of magnets 316 (FIGS. 3B, 3C) attracting cartridge 308*d* magnets 406, 408 and 410, attract cartridge 308*d* back to its original position, shown in FIG. 8A.

If bits 106 have not been or are not loaded into cartridge cavities 402, then, with reference to FIGS. 8B and 8C, a user may continue pushing cartridge 308*a* until cartridge 308*a* engages and pushes cartridge 308*d* far enough out of its respective cell 306 so that a user may grab and pull cartridge 308*a* out of respective cell 306. A bit 106 may then be loaded into cavity 402 of cartridge 308*d*. Cartridge 308*d* is then placed back into its respective receiver cell 306 and pushed in until it engages cartridge 308*a* as shown in FIG. 8D and pushes cartridge 308*a* until its respective magnets 314 and 316 pull cartridge 308*a* back to a proper position in its respective cell 306. Cartridge 308*d* is then released so that its respective magnets 314 and 316 may pull cartridge 308*d* back to its proper position within its respective cell 306. The same procedure used to load bits 106 may also be used to unload or remove bits 106 from a cartridge cavity 402, or to replace bits 106 with other bits 106.

Figure 16:
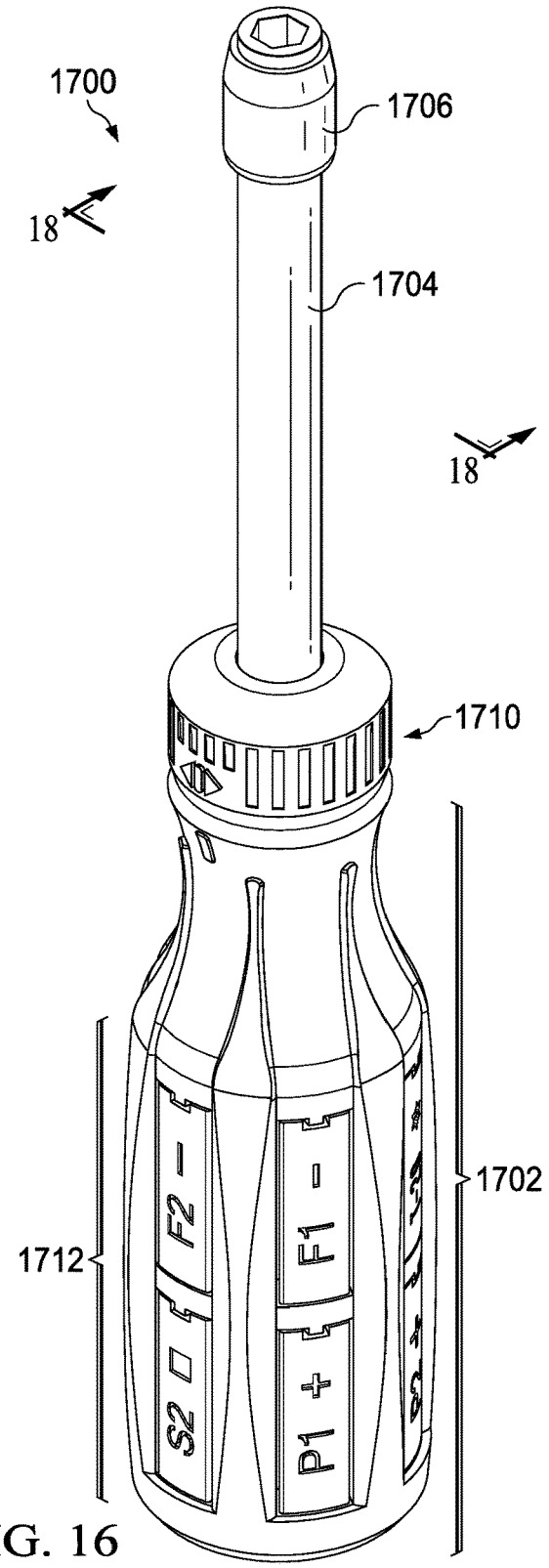
FIG. 16 is a perspective view exemplifying a screwdriver of an alternate embodiment of the invention.
Figure 17:
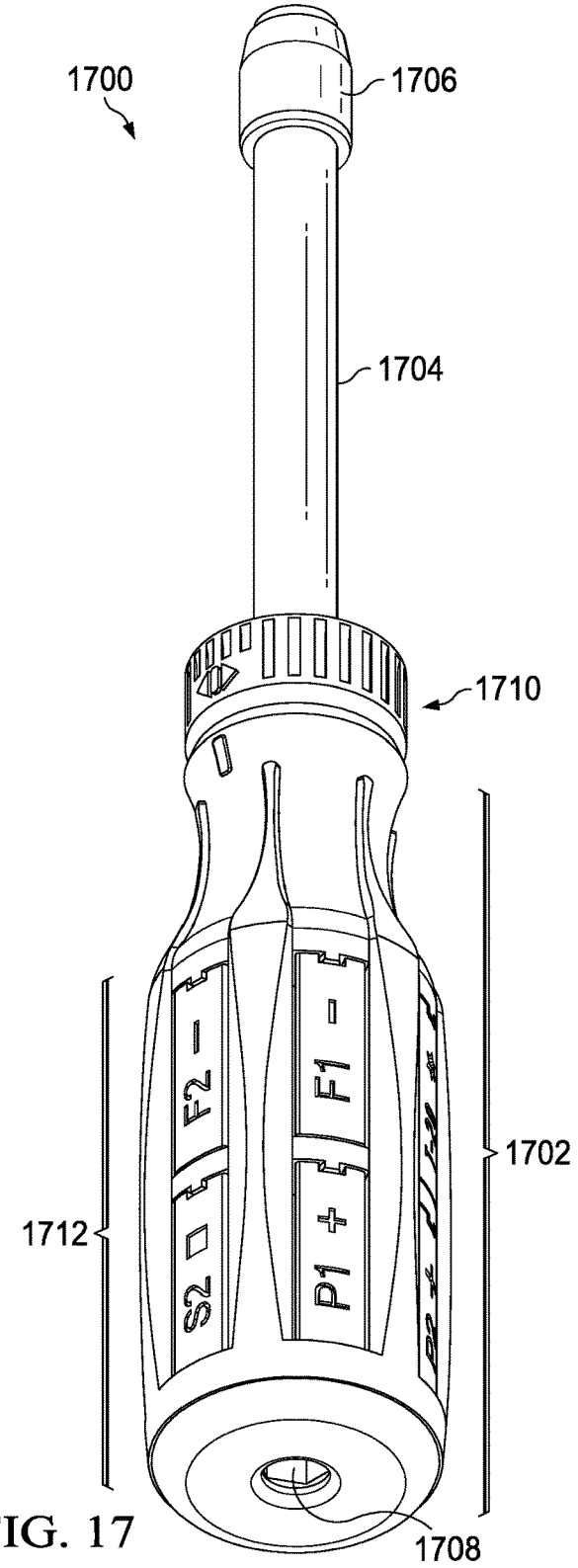
FIG. 17 is a perspective view of the screwdriver of FIG. 16, showing a lower end of the screwdriver.

FIG. 16 depicts a screwdriver 1700 according to an alternative embodiment of the invention, similar to the embodiment of screwdriver 100 described above with respect to FIGS. 1A-15, but in which a selected bit 106 is dropped out of an opening defined in a lower end of the handle, rather than being passed through the shaft 104. Accordingly, as shown in FIG. 16, the screwdriver 1700 preferably includes a handle 1702, a ratchet 1710, a shaft 1704, and a driver 1706. The handle 1702 includes a bit holder portion 1712. As shown in FIG. 17, a lower end of the handle 1702 defines an opening 1708 through which bits 106 may fall out, as discussed below.

Figure 18:
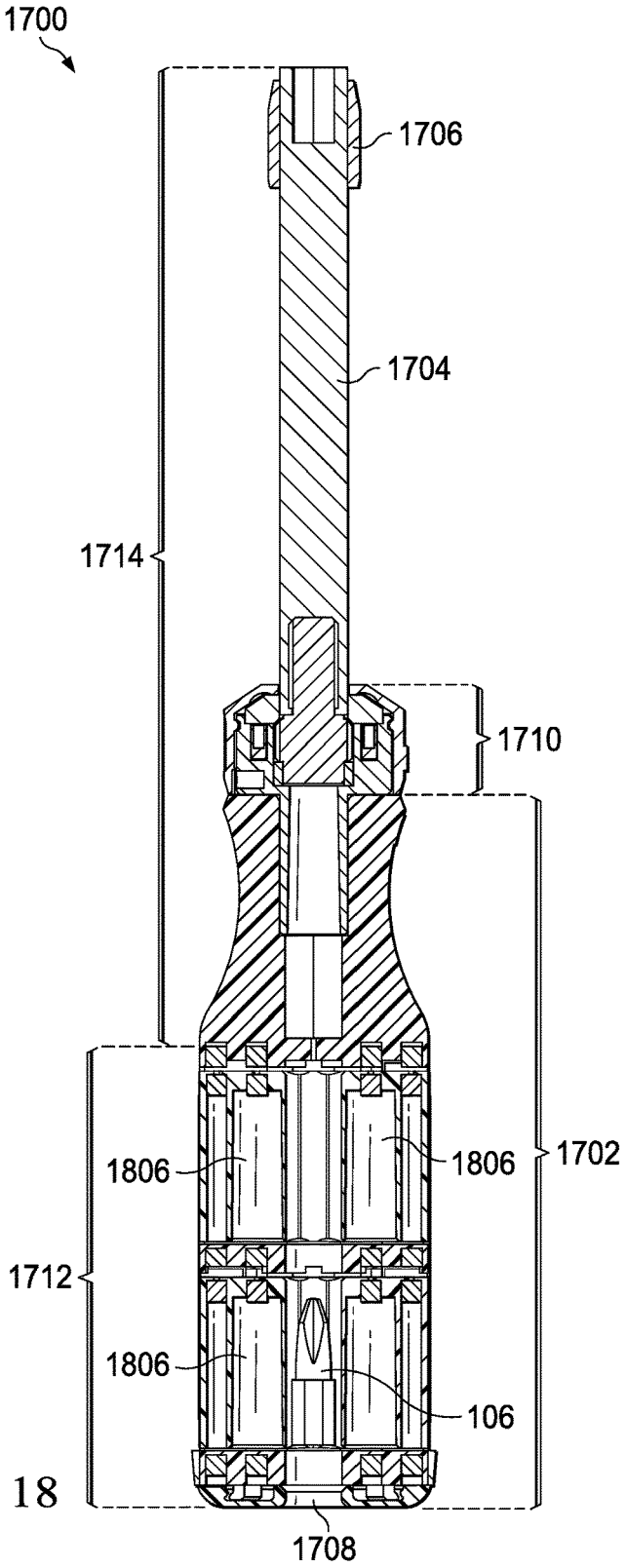
FIG. 18 is a cross-sectional view of the screwdriver of FIG. 16 taken along line 18-18 of FIG. 16.

FIG. 18 depicts a cross-section of the screwdriver 1700 taken along the line 18-18 of FIG. 16. Bit holder portion 1712 of handle 1702 as shown is configured with six columns and two rows defining twelve cells 1806 for holding up to twelve cartridges and bits 106 in a manner similar to screwdriver 100 described above. As with the embodiment described above with respect to FIGS. 1A-15, the number of columns may vary from six columns, and the number of rows may vary from two or three. While not shown, the cells 1806 are adapted for receiving the same cartridges 308 as described above with respect to screwdriver 100 of FIGS. 1A-15. The cells 1806 are virtually identical to the cells 306 but for being oriented 180° (about a horizontal axis) from the cells 306 relative to the rest of the screwdriver, and therefore will not be described in further detail herein.

The portion 1714 of the screwdriver 1700 above the bit holder 1712 is configurable in any suitable manner as a conventional screwdriver, and therefore will not be discussed in further detail herein.

Operation of screwdriver 1700 of FIGS. 16-18 is similar to operation of screwdriver 100 of FIGS. 1A-15, except when a user presses a button 404 of a cartridge 308, a bit falls downwardly, as viewed in FIG. 18, and out through opening 1708, for capture by a user. The user then mounts bit 106 onto driver 1706. When work using the bit 106 is complete, the bit is manually removed from the driver 1706, the screwdriver is oriented with the opening facing upwardly, and the bit is placed in the opening 1708 wherein it falls into the cartridge 308 from whence it came, and the cartridge is pushed back into position shown in FIG. 8A and discussed above.

FIGS. 19-28 depict a power screwdriver 2100 according to an alternate embodiment of the invention wherein multi-bit screwdriver 100 is adapted for being driven by a power tool, such as a power drill (FIGS. 27-28), by adding a shank to a bottom end of the screwdriver. Since power screwdriver 2100 contains many components that are similar or identical to those of screwdriver 100, exemplified by FIGS. 2-15, such components are referred to by the same reference numerals and will not be described in any further detail.

Figure 19:
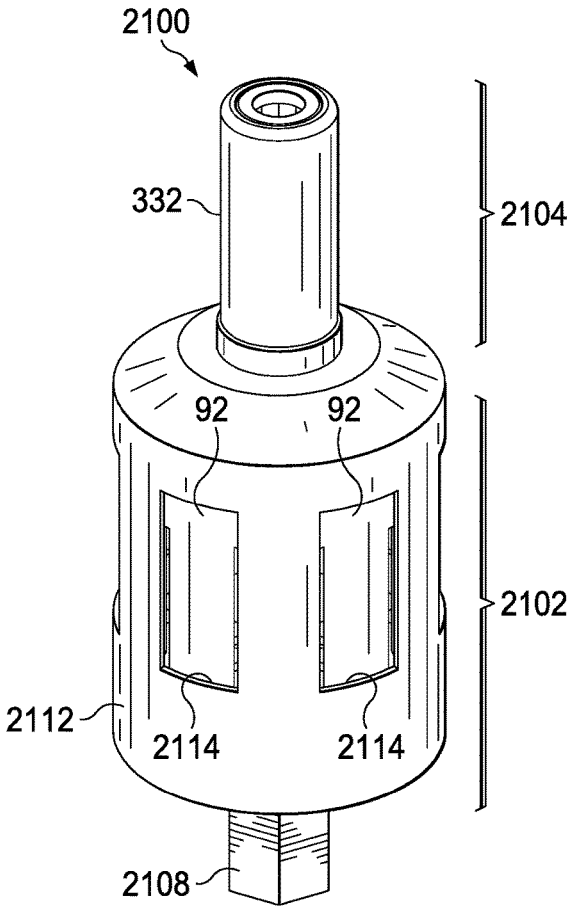
FIGS. 19 and 20 are perspective views of an alternate embodiment of the invention embodying principles of the present invention.
Figure 20:
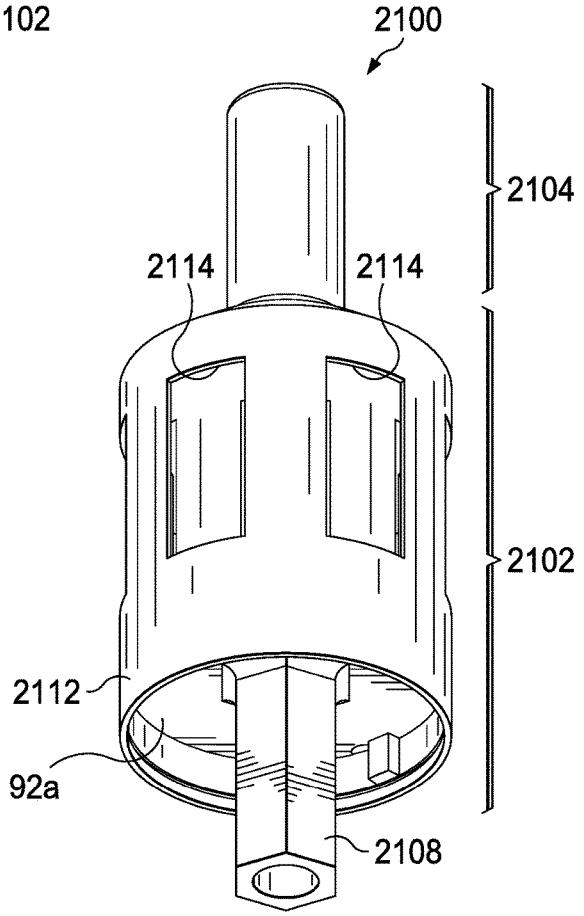

FIGS. 19 and 20 show two perspective views of one embodiment of power screwdriver 2100, including a shank 2108 extending from a bottom side 92*a* of receiver 92, and wherein receiver 92 comprises only a single row 304 (FIG. 3D) of cells 306 (FIG. 3A) and a shaft 2104 is similar to shaft 104, but is relatively shorter. It is understood that power screwdriver 2100 may be configured with multiple rows 304 of cells 306 and that shaft 2104 may be scaled longer or shorter. In a preferred embodiment, an outer cover 2112 envelopes cells 306 of receiver 92, and defines openings 2114 configured for providing access to cells 306 of the receiver. Outer cover 2112 is preferably coupled to or integral with sleeve 332 to move synchronously with the sleeve.

Figure 21:
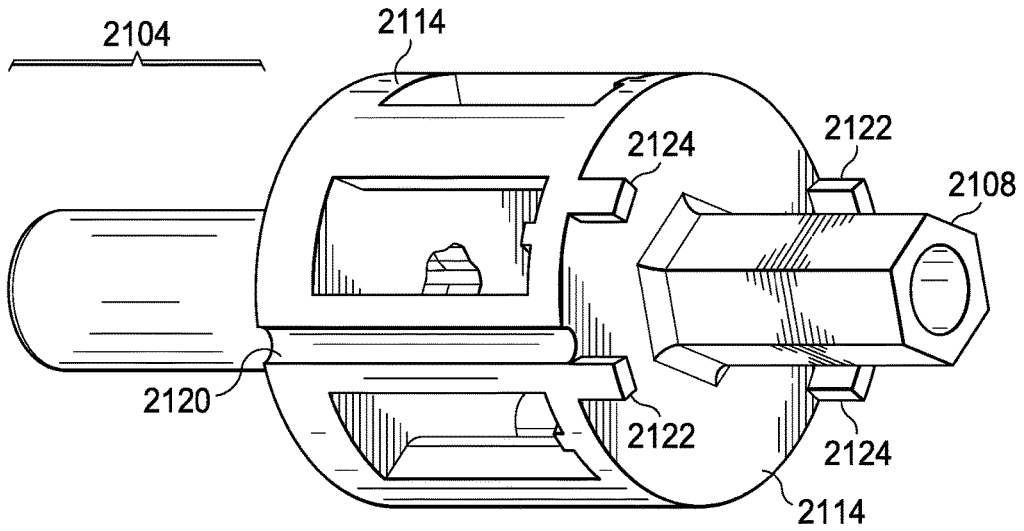
FIG. 21 exemplifies a receiver of the screwdriver without an outer cover.

FIG. 21 shows power screwdriver 2100 receiver 92 without the outer cover 2112. As depicted, a longitudinal groove 2120 is defined in the receiver. In a preferred embodiment, a second longitudinal groove (not shown) is defined on an opposing side of the receiver.

Figure 22:
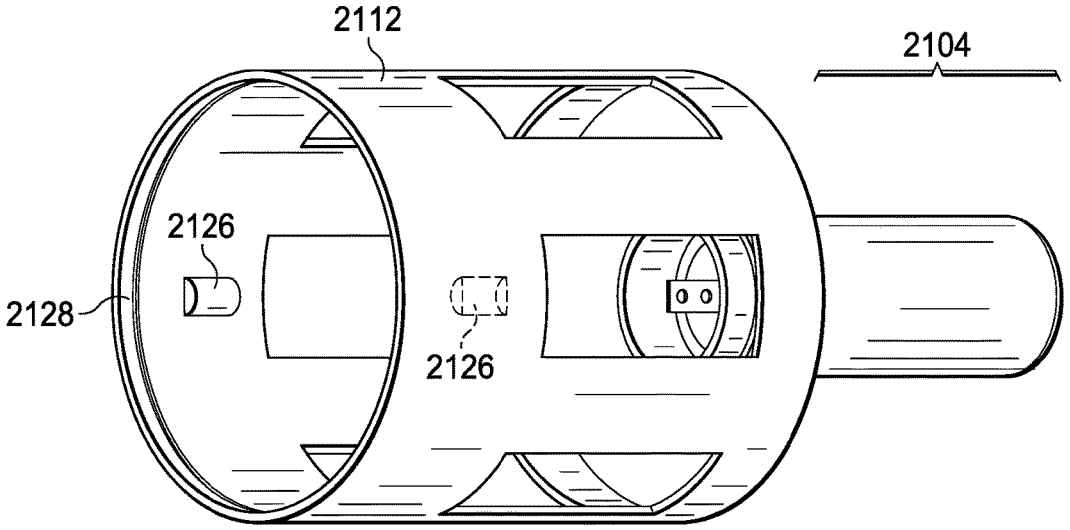
FIG. 22 exemplifies an outer cover of the screwdriver without a receiver.

FIG. 22 shows the power screwdriver 2100 outer cover 2112 without the receiver 92. As depicted, two tongues 2126 extend inwardly from an inward surface of the outer cover. The tongues 2126 are configured to matingly engage and slide along complementary grooves 2120 when outer cover 2112 is positioned about receiver 92. It is noted that outer cover 2112 is coupled to sleeve 332 for synchronous movement with the sleeve. Thus, coil spring 330 (see, e.g., FIG. 9A) that biases sleeve 332 in a forward position toward the end of shaft 2104, also biases outer cover 2112 in a forward position. A retaining ring (not shown) or the like is preferably positioned in a groove 2128 in an end of the outer cover 2112 to limit the bias of spring 330 and the forward movement of the outer cover 2112.

Figure 24:
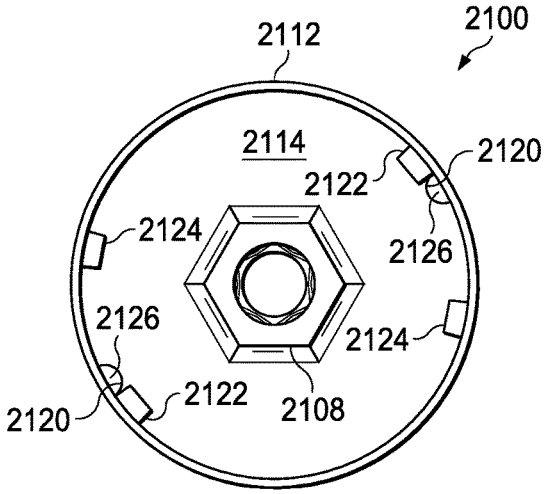
FIG. 24 is a bottom view of the screwdriver of FIG. 23 taken along the line 24-24 of FIG. 23.
Figure 23:
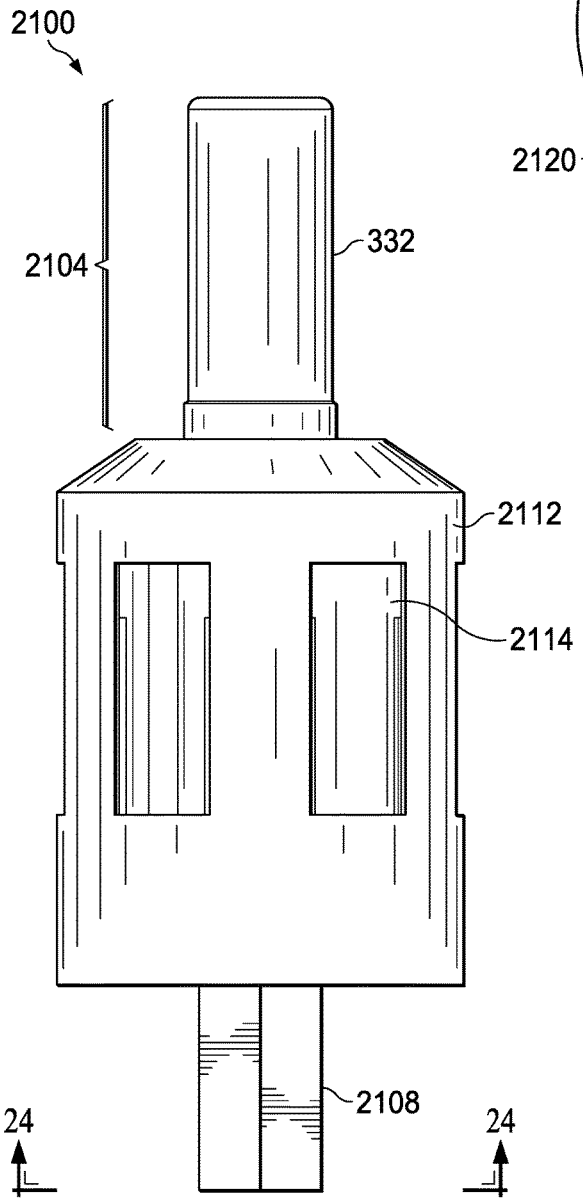
FIG. 23 exemplifies a side view of the screwdriver in a locked position for operation.

FIGS. 23 and 24 illustrate an operating mode of power screwdriver 2100. As shown most clearly in FIG. 24, two tongues 2126 engage complementary grooves 2120 permitting spring 330 to slide outer cover 2112 and sleeve 332 into a forward position. In such position, outer cover 2112 covers cells 306, precluding external access to cartridges 308, and also preventing cartridges 308 from flying out of respective cells from centrifugal force generated when a power drill spins screwdriver 2100 at high speeds. It is noted that open stops 2122 and closed stops 2124 limit how much outer cover 2112 can be rotated when opening or closing, respectively, outer cover 2112.

Figure 26:
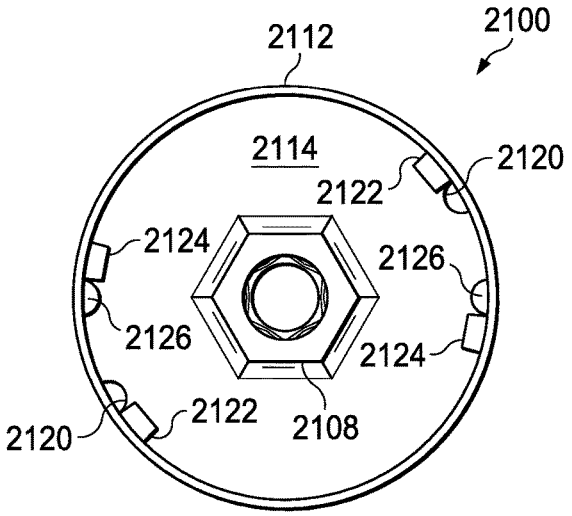
FIG. 26 is a bottom view of the screwdriver of FIG. 25 taken along the line 26-26 of FIG. 25.
Figure 25:
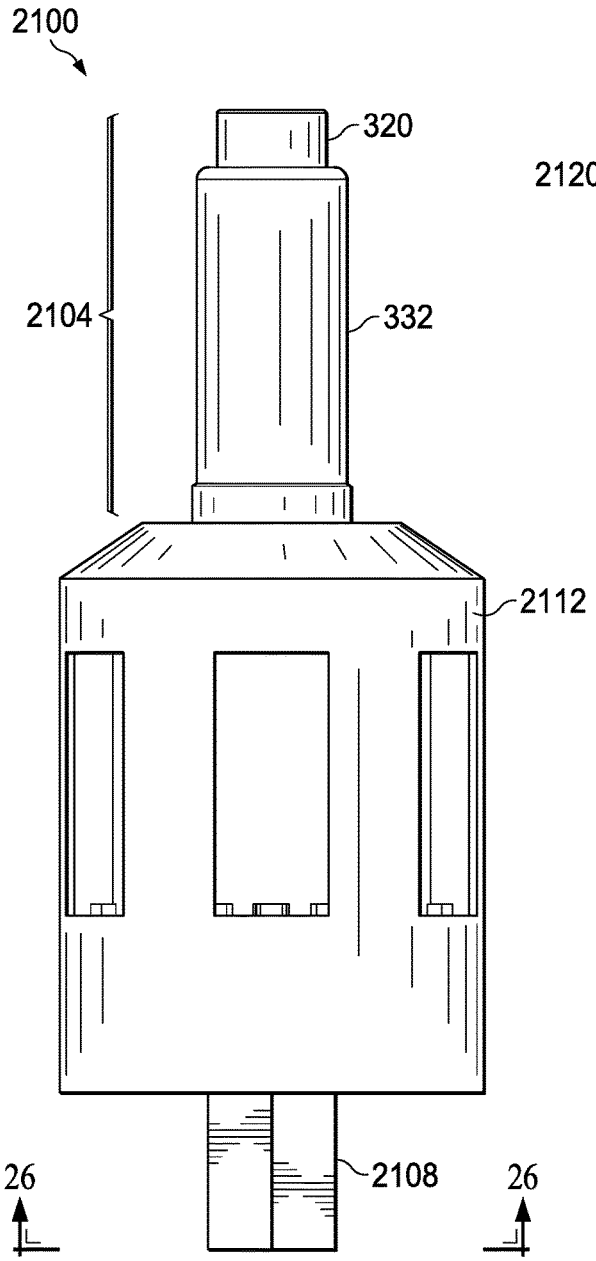
FIG. 25 exemplifies a side view of the screwdriver in an unlocked position for changing a bit.

FIGS. 25 and 26 illustrate a bit changing mode of power screwdriver 2100. As shown most clearly in FIG. 26, two tongues 2126 do not engage complementary grooves 2120, and so restrain outer cover 2112 and sleeve 332 in a rearward position. In such position, outer cover 2112 allows access to cells 306, thereby permitting external access to cartridges 308 so bits 106 may be selected, removed, or changed, as discussed above with respect to FIGS. 2-15.

Figure 27:
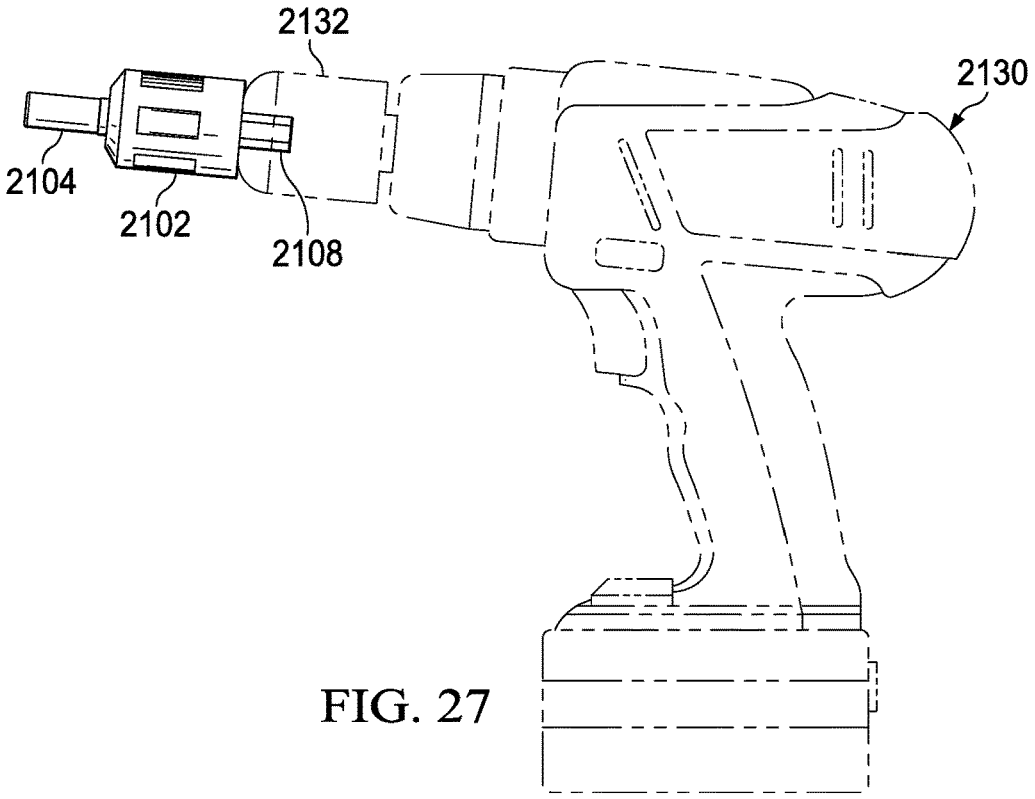
FIG. 27 exemplifies how the embodiment of FIGS. 19 and 20 may be mounted to a chuck of a power drill.
Figure 28:
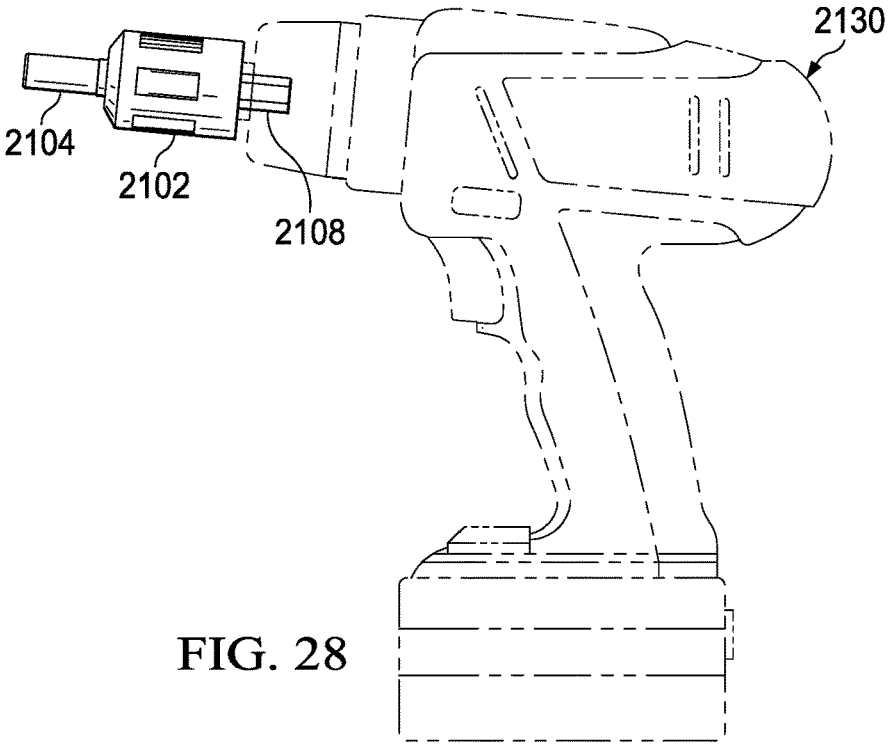
FIG. 28 exemplifies how the embodiment of FIGS. 19 and 20 may be permanently mounted to a power drill.

FIGS. 27 and 28 exemplify how screwdriver 2100 may be coupled to a power drill 2130. In FIG. 27, shank 2108 is secured in a chuck 2132 to thereby form a temporary coupling. In FIG. 28, a more permanent coupling between screwdriver 2100 and power drill 2130 is formed when shank 2108 is secured directly to power drill 2130.

It is understood that the present invention may take many forms and embodiments. Accordingly, several variations may be made in the foregoing without departing from the spirit or the scope of the invention. For example, someone could use similar cartridge configuration but bias them with elastic or other spring material. In another example, the function performed by the tongues 2126 and grooves 2120 for the outer cover 2112 and receiver 92 may be performed by other means, such as ball and detent. In yet another example, second grooves similar to grooves 2120 could be formed in receiver 92 for receiving tongues 2126 in the closed position of outer cover 2112. In a still further example, the function performed by magnets 314, 316, 406, 408, and 410 for biasing cartridges 308 as described above could be performed by springs

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A locking mechanism for securing for use an item selected and retrieved from an opening in a storage device configured for storing one or more items, the locking mechanism comprising:

a tubular shaft extending from the opening in the storage device for receiving the selected item from the storage device;

a passageway defined within the tubular shaft for facilitating travel of the selected item from the opening in the storage device to an end of the shaft opposing the opening; and at least one locking block and one stop configured for securing the selected item at the end of the tubular shaft opposing the opening;

wherein the tubular shaft further comprises:

a barrel and a sleeve slidingly fitted about the barrel, the barrel including an entry end proximate to the opening in the storage device, and an exit end opposite the entry end, the sleeve being slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID;

at least one coil spring positioned for biasing the sleeve toward the first position;

at least one opening defined in a wall of the barrel;

at least one leaf spring mounted on the barrel between the barrel and the sleeve; and the at least one locking block mounted on the at least one leaf spring and positioned adjacent the at least one opening of the barrel;

wherein, when the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the locking blocks to move away from the interior of the barrel;

wherein the at least one locking block is configured with at least one angled side to permit a selected item traveling along the barrel from the entry end to the exit end to move the at least one locking block back from the interior of the barrel to permit the selected item to travel past the locking blocks;

wherein when the selected item is proximate to the exit end of the barrel, the locking blocks move back toward the interior of the barrel and restrain the item from moving back toward the entry end of the barrel; and wherein the barrel defines a stop at the exit end that, together with the locking blocks, locks a item in the exit end of the barrel.

2. The locking mechanism of claim 1 wherein the one or more items comprise one or more bits.

3. The locking mechanism of claim 1 wherein the one or more items comprise at least one of an artist charcoal pencil, children's crayons, drill bits, thread cutting taps, bobbins for sewing, spices, gauge pins, screwdriver bits, and fishing weights.

4. The locking mechanism of claim 1 wherein the one or more items comprise one or more bits, each of the one or more bits having a head portion and a base portion, the base portion defining a plurality of sides, and wherein the tubular shaft defines an interior portion having a plurality of lands corresponding in number to the plurality of sides of the base portion of the one or more bits.

5. The locking mechanism of claim 1 wherein the one or more items comprise one or more bits, each of the one or more bits having a head portion and a base portion, the base portion defining a plurality of sides, and wherein the tubular shaft defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

6. The locking mechanism of claim 1 wherein the one or more storage items comprise one or more bits, each of the one or more bits having a head portion and a base portion, the base portion defining a plurality of concave sides, and wherein the tubular shaft defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

7. The locking mechanism of claim 1 wherein the one or more storage items comprise one or more bits, each of the one or more bits having a head portion and a base portion, the base portion defining a plurality of concave sides, the sides being conically canted toward the head portion, and wherein the tubular shaft defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

8. The locking mechanism of claim 1 wherein the tubular shaft further comprises:

a barrel and a sleeve slidingly fitted about the barrel, the barrel including an entry end proximate to the opening in the storage device, and an exit end opposite the entry end;

at least one opening defined in a wall of the barrel;

at least one leaf spring mounted on the barrel between the barrel and the sleeve; and at least one locking block mounted on the at least one leaf spring and positioned within the at least one opening of the barrel;

wherein the at least one leaf spring biases the at least one locking block toward the interior of the barrel;

wherein the at least one locking block is configured with at least one angled side to permit a selected item traveling along the barrel from the entry end to the exit end to move the at least one locking block back from the interior of the barrel to permit a selected item to travel past the locking blocks;

wherein when the selected item proximate to the exit end of the barrel, the locking blocks move back toward the interior of the barrel and restrain the selected item from moving back toward the entry end of the barrel; and wherein the barrel defines a stop at the exit end that, together with the locking blocks, locks an item in the exit end of the barrel.

9. The locking mechanism of claim 1 wherein the tubular shaft further comprises:

a barrel and a sleeve slidingly fitted about the barrel, the barrel including an entry end proximate to the opening in the storage device, and an exit end opposite the entry end, the sleeve being slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID;

at least one coil spring positioned for biasing the sleeve toward the first position;

at least one opening defined in a wall of the barrel;

at least one leaf spring mounted on the barrel between the barrel and the sleeve; and at least one locking block mounted on the at least one leaf spring and positioned adjacent the at least one opening of the barrel;

wherein when the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the at least one locking block to move away from the interior of the barrel;

wherein the at least one locking block and at least one opening are configured with complementary wedge shapes that limit how far the at least one locking block may move toward the interior of the barrel;

wherein the at least one locking block is configured with at least one angled side to permit a selected item traveling along the barrel from the entry end toward the exit end to move the at least one locking block back from the interior of the barrel to permit the at least one item to travel past the locking blocks;

wherein, when the selected item is proximate to the exit end of the barrel, the locking blocks move back toward the interior of the barrel and restrain the selected item from moving toward the entry end of the barrel; and wherein the barrel defines a stop at the exit end that, together with the locking blocks, locks a selected item in the exit end of the barrel.

10. A locking mechanism for securing for use an item selected and retrieved from an opening in a storage device configured for storing one or more items, the locking mechanism comprising:

a tubular shaft extending from the opening in the storage device for receiving the selected item from the storage device, the tubular shaft including a barrel and a sleeve slidingly fitted about the barrel, the barrel including an entry end proximate to the opening in the storage device, and an exit end opposite the entry end;

a passageway defined within the barrel for facilitating travel of the selected item from the opening in the storage device to an end of the shaft opposing the opening;

at least one opening defined in a wall of the barrel;

at least one leaf spring mounted on the barrel between the barrel and the sleeve; and at least one locking block mounted on the at least one leaf spring and positioned within the at least one opening of the barrel;

wherein the at least one leaf spring biases the at least one locking block toward the interior of the barrel;

wherein the at least one locking block is configured with at least one angled side to permit a selected item traveling along the barrel from the entry end to the exit end to move the at least one locking block back from the interior of the barrel to permit a selected item to travel past the locking blocks;

wherein when the selected item is proximate to the exit end of the barrel, the locking blocks move back toward the interior of the barrel and restrain the selected item from moving back toward the entry end of the barrel;

wherein the barrel defines a stop at the exit end that, together with the locking blocks, locks an item in the exit end of the barrel;

wherein the sleeve is slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID;

wherein the locking mechanism further comprises at least one coil spring positioned for biasing the sleeve toward the first position; and wherein, when the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the locking blocks to move away from the interior of the barrel.

11. The locking mechanism of claim 10 wherein the one or more items comprise one or more bits.

12. The locking mechanism of claim 10 wherein the one or more items comprise at least one of an artist charcoal pencil, children's crayons, drill bits, thread cutting taps, bobbins for sewing, spices, gauge pins, screwdriver bits, and fishing weights.

13. The locking mechanism of claim 10 wherein the one or more items comprise one or more bits, each of the one or more bits having a head portion and a base portion, the base portion defining a plurality of sides, and wherein the barrel defines an interior portion having a plurality of lands corresponding in number to the plurality of sides of the base portion of the one or more bits.

14. The locking mechanism of claim 10 wherein the one or more items comprise one or more bits, each of the one or more bits having a head portion and a base portion, the base portion defining a plurality of sides, and wherein the barrel defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

15. The locking mechanism of claim 10 wherein the one or more items comprise one or more bits, each of the one or more bits having a head portion and a base portion, the base portion defining a plurality of concave sides, and wherein the barrel defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

16. The locking mechanism of claim 10 wherein the one or more items comprise one or more bits, each of the one or more bits having a head portion and a base portion, the base portion defining a plurality of concave sides, the sides being conically canted toward the head portion, and wherein the barrel defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end.

17. The locking mechanism of claim 10:

wherein the sleeve is slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID;

wherein the locking mechanism further comprises at least one coil spring positioned for biasing the sleeve toward the first position;

wherein, when the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the locking blocks to move away from the interior of the barrel;

wherein the at least one locking block and at least one opening are configured with complementary wedge shapes that limit how far the at least one locking block may move toward the interior of the barrel;

wherein the at least one locking block is configured with at least one angled side to permit a selected item traveling along the barrel from the entry end toward the exit end to move the at least one locking block back from the interior of the barrel to permit the at least one item to travel past the locking blocks;

wherein, when the selected item is proximate to the exit end of the barrel, the locking blocks move back toward the interior of the barrel and restrain the selected item from moving toward the entry end of the barrel; and wherein the barrel defines a stop at the exit end that, together with the locking blocks, locks a selected item in the exit end of the barrel.

18. The locking mechanism of claim 10:

wherein the one or more items comprise one or more bits, each of the one or more bits having a head portion and a base portion, the base portion defining a plurality of concave sides, the sides being conically canted toward the head portion, and wherein the barrel defines an interior portion having a plurality of lands corresponding in number to the plurality of sides of the base portions of the one or more bits, the interior portion having an entry end proximate to the opening in the storage device, and an exit end opposing the entry end, and wherein the lands are smaller at the entry end than at the exit end, and substantially conform to the shape of the base portion of a selected bit at the exit end;

wherein the sleeve is slidable between a first position proximate to the exit end, and a second position distal from the exit end, the sleeve further defining a taper on an interior wall of the sleeve, the taper providing a transition between a first interior diameter ("ID") of the sleeve proximate the entry end and a second ID of the sleeve proximate the exit end, the second ID being greater than the first ID;

wherein the locking mechanism further comprises at least one coil spring positioned for biasing the sleeve toward the first position;

wherein, when the sleeve is in the first position, the taper urges the at least one leaf spring to bias the at least one locking block toward the interior of the barrel, and when the sleeve is in the second position, the taper releases the at least one leaf spring from biasing the at least one locking block toward the interior of the barrel to cause the locking blocks to move away from the interior of the barrel;

wherein the at least one locking block and at least one opening are configured with complementary wedge shapes that limit how far the at least one locking block may move toward the interior of the barrel;

wherein the at least one locking block is configured with at least one angled side to permit a selected bit traveling along the barrel from the entry end toward the exit end to move the at least one locking block back from the interior of the barrel to permit the at least one bit to travel past the locking blocks;

wherein, when the selected bit is proximate to the exit end of the barrel, the locking blocks move back toward the interior of the barrel and restrain the selected bit from moving toward the entry end of the barrel; and wherein the barrel defines a stop at the exit end that, together with the locking blocks, locks a selected bit in the exit end of the barrel.

* * * * *